US011499327B1

(12) United States Patent
MacKarvich

(10) Patent No.: US 11,499,327 B1
(45) Date of Patent: Nov. 15, 2022

(54) GUARDRAIL MOUNTING BRACKET FOR STAIRCASE

(71) Applicant: Charles J. MacKarvich, Atlanta, GA (US)

(72) Inventor: Charles J. MacKarvich, Atlanta, GA (US)

( * ) Notice: Subject to any disclaimer, the term of this patent is extended or adjusted under 35 U.S.C. 154(b) by 0 days.

(21) Appl. No.: 17/404,069

(22) Filed: Aug. 17, 2021

(51) Int. Cl.
*E04G 21/32* (2006.01)

(52) U.S. Cl.
CPC ..... *E04G 21/3242* (2013.01)

(58) Field of Classification Search
CPC ..... E04G 21/3242; E04G 21/3233; E04G 21/3223; E04G 21/3204; E04G 5/045; B25B 5/006; B25B 5/02; B25B 5/102; Y10T 29/49998; E04F 11/18; E04F 11/1812; E04F 11/1817
USPC ..... 256/68
See application file for complete search history.

(56) References Cited

U.S. PATENT DOCUMENTS 1,239,462 A * 9/1917 Clinkunbroomer ..... B28B 7/225 249/189
2,907,598 A * 10/1959 Hart ..... A47B 91/02 403/112
3,385,400 A * 5/1968 Whitsett ..... E04G 5/06 248/246
3,480,242 A * 11/1969 Cleveland ..... E04G 21/3242 248/231.71
3,632,089 A * 1/1972 Smith ..... E04F 11/18 256/47
3,756,568 A * 9/1973 Mocny ..... E04G 21/3242 256/65.1
3,863,900 A * 2/1975 Dagiel ..... E04G 21/3233 248/231.71
3,881,698 A * 5/1975 Marsh ..... E04G 21/3233 248/231.41
3,920,221 A * 11/1975 Berry ..... E04G 21/3233 52/707
3,938,619 A * 2/1976 Kurabayashi ..... E04G 21/3233 182/113
3,995,833 A * 12/1976 McLaughlin ..... E04G 21/3242 256/65.14
3,995,834 A * 12/1976 Melfi ..... E04G 21/3233 256/59

(Continued)

OTHER PUBLICATIONS

Mackarvich, Charles J.; Non-Final Office Action for U.S. Appl. No. 17/404,117, filed Aug. 17, 2021, dated Mar. 18, 2022, 14 pgs.

(Continued)

*Primary Examiner* — Colleen M Chavchavadze
*Assistant Examiner* — Shiref M Mekhaeil
(74) *Attorney, Agent, or Firm* — Taylor English Duma LLP

(57) ABSTRACT

A guardrail mounting bracket for a staircase includes an upper clamping bracket comprising an upper post engagement portion and an upper stair engagement portion, the upper stair engagement portion defining an upper stair engagement surface; a lower clamping bracket comprising a lower post engagement portion and a lower stair engagement portion, the lower stair engagement portion defining a lower stair engagement surface; and a front clamping bracket coupled to the lower clamping bracket and defining a front stair engagement portion.

18 Claims, 12 Drawing Sheets

(56) References Cited

U.S. PATENT DOCUMENTS 4,045,003 A * 8/1977 McCluskey ..... E04F 11/1812 256/59
4,078,633 A * 3/1978 Fahy ..... E04G 3/265 182/229
4,253,648 A * 3/1981 Meeks ..... B25B 5/16 269/282
4,457,397 A * 7/1984 Scala ..... E04G 1/24 182/116
4,669,577 A * 6/1987 Werner ..... E04G 21/3242 248/231.71
4,846,305 A * 7/1989 Kupfert ..... E06C 7/42 182/109
5,067,586 A * 11/1991 Myers ..... E04G 5/041 248/237
5,462,249 A * 10/1995 Calzone ..... B60P 1/43 292/256.73
5,527,016 A * 6/1996 Wilkerson, Jr. ..... E04F 21/00 52/64
6,038,829 A * 3/2000 Franks ..... E04G 21/3242 52/645
6,039,150 A * 3/2000 Palmer ..... E04G 21/3223 182/113
6,279,880 B1 * 8/2001 Hawks, Jr. ..... E04F 11/1834 403/109.1
6,328,285 B1 * 12/2001 Wiseman ..... E04H 12/2269 256/67
6,481,697 B1 * 11/2002 Brown ..... E04F 11/1834 256/64
6,585,080 B2 * 7/2003 Murray ..... E04G 21/3242 248/231.71
6,679,482 B2 * 1/2004 Allenbaugh ..... E04G 21/3242 248/231.71
7,234,689 B2 * 6/2007 Kuenzel ..... E04G 21/3233 182/113
7,530,551 B2 * 5/2009 Kuenzel ..... E04G 21/3233 182/113
7,806,232 B2 * 10/2010 Thomas ..... E04G 21/3223 182/113
8,448,923 B1 * 5/2013 Schad ..... E04G 21/3219 256/65.03
8,833,008 B2 * 9/2014 Truckner ..... E04F 11/181 52/191
9,670,685 B2 * 6/2017 Landry ..... A62B 35/0068
9,683,372 B2 * 6/2017 Meier ..... E04F 11/035
10,487,522 B2 * 11/2019 Melic ..... E04G 21/3242
11,007,832 B1 * 5/2021 Rebick ..... B60D 1/52
2003/0097729 A1 * 5/2003 Kaufman ..... A47G 27/065 16/12
2003/0132427 A1 * 7/2003 Allenbaugh ..... E04G 21/3233 256/65.14
2005/0046100 A1 * 3/2005 Pang ..... B23K 37/04 269/244
2008/0196330 A1 * 8/2008 Frank ..... E04H 3/12 52/182
2009/0266969 A1 * 10/2009 Costello ..... B28B 7/225 249/14
2011/0167740 A1 * 7/2011 Truckner ..... E04F 11/181 52/698
2018/0283022 A1 * 10/2018 Gentile ..... E04H 17/22
2021/0331347 A1 * 10/2021 Glentz ..... B28B 7/225
2022/0056715 A1 * 2/2022 O'Mara ..... E04G 21/3242

OTHER PUBLICATIONS

Mackarvich, Charles J.; Requirement for Restriction/Election for U.S. Appl. No. 17/404,117, filed Mar. 17, 2021, dated Feb. 8, 2022, 8 pgs.

Mackarvich, Charles J.; Final Office Action for U.S. Appl. No. 17/404,117, filed Aug. 17, 2021, dated Jul. 26, 2022, 22 pgs.

* cited by examiner

GUARDRAIL MOUNTING BRACKET FOR STAIRCASE

TECHNICAL FIELD

This disclosure relates to building construction. More specifically, this disclosure relates to a mounting bracket for mounting a guardrail to a staircase.

BACKGROUND

Construction sites often have staircases that require guardrails or other safety measures. Staircase guardrails are typically placed along an open side of the staircase. The guardrails can provide a stable gripping point for workers as they ascend and descend the staircase and can further prevent accidental falls over the open side of the staircase. In order to be effective, the guardrails must be properly secured to the staircase. Guardrails that are not properly secured can wobble or detach from the staircase and can fail to provide a stable gripping point and/or to prevent falls.

SUMMARY

It is to be understood that this summary is not an extensive overview of the disclosure. This summary is exemplary and not restrictive, and it is intended neither to identify key or critical elements of the disclosure nor delineate the scope thereof. The sole purpose of this summary is to explain and exemplify certain concepts of the disclosure as an introduction to the following complete and extensive detailed description.

Disclosed is a guardrail mounting bracket for a staircase, the guardrail mounting bracket comprising an upper clamping bracket comprising an upper post engagement portion and an upper stair engagement portion, the upper stair engagement portion defining an upper stair engagement surface; a lower clamping bracket comprising a lower post engagement portion and a lower stair engagement portion, the lower stair engagement portion defining a lower stair engagement surface; and a front clamping bracket coupled to the lower clamping bracket and defining a front stair engagement portion.

Also disclosed is a staircase guardrail system comprising a plurality of guardrails defining an upright boundary, the plurality of guardrails comprising a guardrail post and a lateral guardrail, the guardrail post defining an upper section and a lower section; and a guardrail mounting bracket comprising: an upper clamping bracket mounted to the upper section of the guardrail post; a lower clamping bracket mounted to the lower section of the guardrail post; and a front clamping bracket coupled to the lower clamping bracket.

A method of mounting a staircase guardrail system to a staircase, the method comprising providing a staircase guardrail system comprising a lower clamping bracket, an upper clamping bracket, a front clamping bracket, and a plurality of guardrails, each of the lower clamping bracket and the upper clamping bracket mounted to a guardrail post of the plurality of guardrails, the front clamping bracket coupled to the lower clamping bracket by a connector; abutting the upper clamping bracket against an upper staircase surface of a staircase; and tightening a tightening fastener on the connector, wherein tightening the tightening fastener on the connector biases the front clamping bracket against an upper front edge of a stair of the staircase and biases the lower clamping bracket against a lower staircase surface of the staircase.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Figure 1:
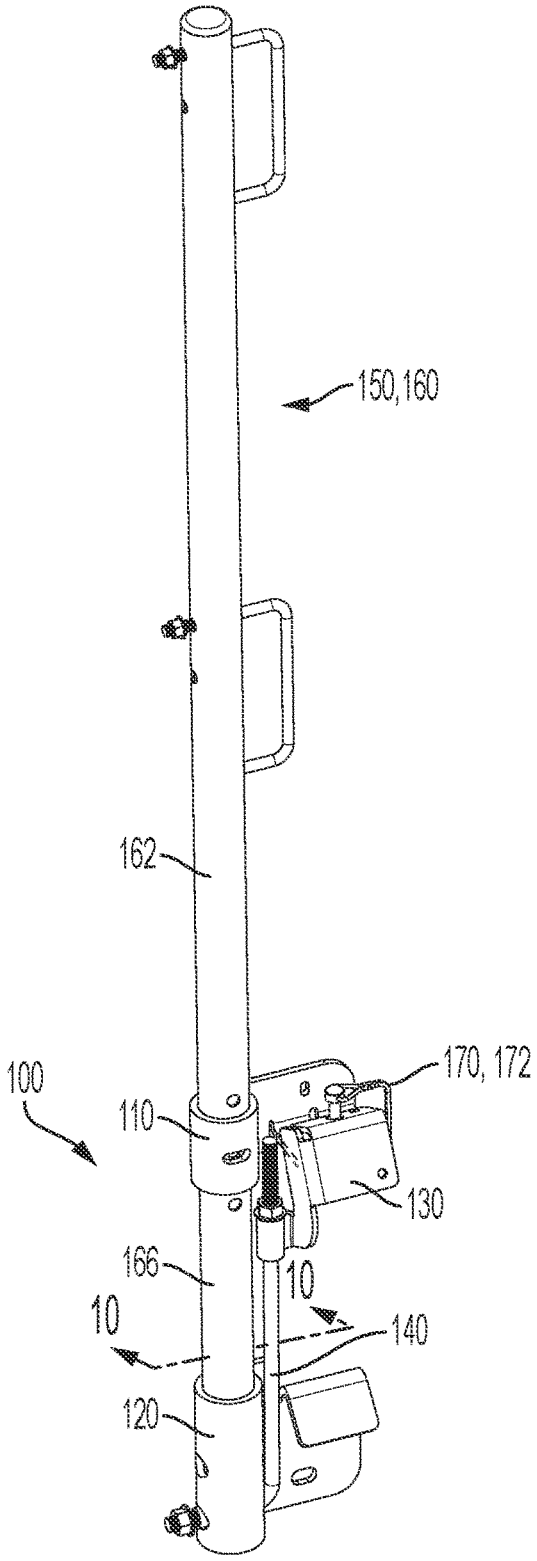
FIG. 1 is a perspective view of a guardrail mounting bracket for a staircase, in accordance with one aspect of the present disclosure, wherein the guardrail mounting bracket in oriented in a storage configuration and wherein the guardrail mounting bracket is secured to a guardrail post.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed in the present application is a guardrail mounting bracket for a staircase and associated methods, systems, devices, and various apparatus. The guardrail mounting bracket can comprise an upper clamping bracket, a lower clamping bracket, and a front clamping bracket. It would be understood by one of skill in the art that the disclosed guardrail mounting bracket is described in but a few exemplary aspects among many. No particular terminology or description should be considered limiting on the disclosure or the scope of any claims issuing therefrom.

Figure 2:
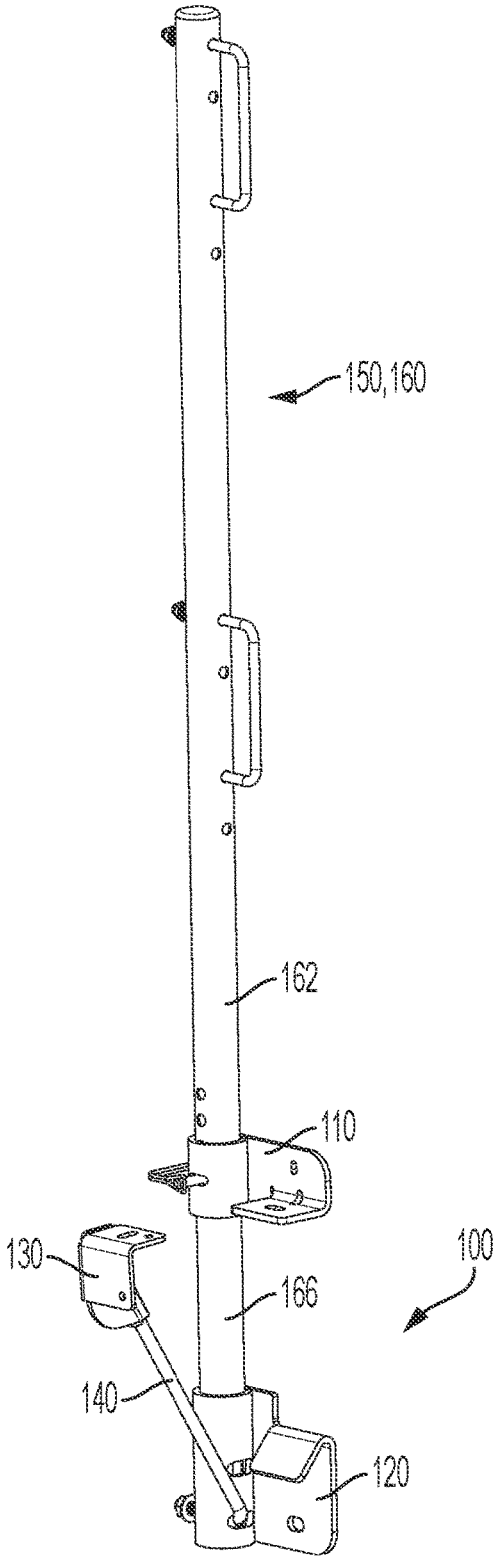
FIG. 2 is a perspective view of the guardrail mounting bracket of FIG. 1 secured to the guardrail of FIG. 1, wherein the guardrail mounting bracket is oriented in a use configuration.

FIGS. 1 and 2 illustrate a guardrail mounting bracket 100 in accordance with an aspect of the present disclosure. The guardrail mounting bracket 100 can be configured to secure one or more guardrails 150 to a staircase 310 (shown in FIG. 3) comprising a plurality of stairs 315 (shown in FIG. 3). Example aspects of the guardrails 150 can comprise steel. In some aspects the guardrails 150 can be formed as extruded steel posts. In other aspects, the guardrails 150 can comprise any other suitable material known in the art, including but not limited to other metals, and/or can be manufactured using any other desired method. According to example aspects, the guardrail mounting bracket 100 can be attached to one of the guardrails 150, such as a guardrail post 160, as shown. The guardrail post 160 can generally define an upper section 162, a lower section 564 (shown in FIG. 5A), and an intermediate section 166 extending between the upper section 162 and the lower section 564. Example aspects of the guardrail mounting bracket 100 can comprise an upper clamping bracket 110, a lower clamping bracket 120, and a front clamping bracket 130. Each of the upper clamping bracket 110 and lower clamping bracket 120 can be coupled to the guardrail post 160. For example, the upper clamping bracket 110 can be coupled to the upper section 162 of the guardrail post 160, and the lower clamping bracket 120 can be coupled to the lower section 564 of the guardrail post 160. When the guardrail mounting bracket 100 is mounted to the staircase 310, the upper clamping bracket 110 can engage an upper staircase surface 330 (shown in FIG. 3) of the staircase 310, and the lower clamping bracket 120 can engage a lower staircase surface 1332 (shown in FIG. 13B) of the staircase 310 to clamp a portion of the staircase 310 therebetween. Furthermore, at least one of the upper clamping bracket 110 and lower clamping bracket 120 can be selectively repositionable along the guardrail post 160 to accommodate stairs 315 of varying heights and widths. In the present aspect, both of the upper clamping bracket 110 and lower clamping bracket 120 can be selectively repositioned along the guardrail post 160, as described in further detail below.

The front clamping bracket 130 can be coupled to the lower clamping bracket 120 by a connector, such as a connector bolt 140. The connector bolt 140 can be pivotably coupled to the lower clamping bracket 120 to allow the front clamping bracket 130 to pivot relative to the lower clamping bracket 120. The front clamping bracket 130 can be configured to engage an upper front edge 320 (shown in FIG. 3) of a corresponding one of the stairs 315. In example aspects, the front clamping bracket 130 can be selectively repositioned along the connector bolt 140 to tighten the front clamping bracket 130 against the upper front edge 320 of the corresponding stair 315, as described in further detail below.

As shown in FIG. 1, the front clamping bracket 130 can also be selectively secured to the upper clamping bracket 110 in a storage configuration of the guardrail mounting bracket 100. In the storage configuration, the front clamping bracket 130 can be prohibited from pivoting relative to the lower clamping bracket 120. A storage fastener 170 can be provided, such as a storage lock pin 172, to secure the front clamping bracket 130 to the upper clamping bracket 110. In other aspects, any other suitable fastener can be provided for retaining the guardrail mounting bracket 100 in the storage configuration, such as a clip, bolt, screw, clamp, tie, or the like. The guardrail mounting bracket 100 can be oriented in the storage configuration to restrict movement of the connector bolt 140 and the front clamping bracket 130 during transport of the guardrail mounting bracket 100.

The guardrail mounting bracket 100 can further be configured in a use configuration, as shown in FIG. 2. To configure the guardrail mounting bracket 100 in the use configuration, the storage fastener 170 can be disengaged from the front clamping bracket 130, and the front clamping bracket 130 can be permitted to pivot relative to the lower clamping bracket 120 via the connector bolt 140. Example aspects of the upper clamping bracket 110, lower clamping bracket 120, and front clamping bracket 130 can comprise a rigid material having a durability suitable for clamping onto the staircase 310. For example, the upper clamping bracket 110, lower clamping bracket 120, and front clamping bracket 130 can comprise steel in some aspects. More specifically, in some aspects, each of the upper clamping bracket 110, lower clamping bracket 120, and/or front clamping bracket 130 can be formed by laser-cutting and bending monolithic steel plates. However, in other aspects, the any of the upper clamping bracket 110, lower clamping bracket 120, and/or front clamping bracket 130 may not be monolithically formed and/or may be manufactured using other desired methods, such as stamping, casting, or machining. In other aspects, the upper clamping bracket 110, lower clamping bracket 120, and/or front clamping bracket 130 can comprise any other suitable material or combination of materials having suitable durability, such as, for example, other metals, plastics, composites, and the like.

Figure 3:
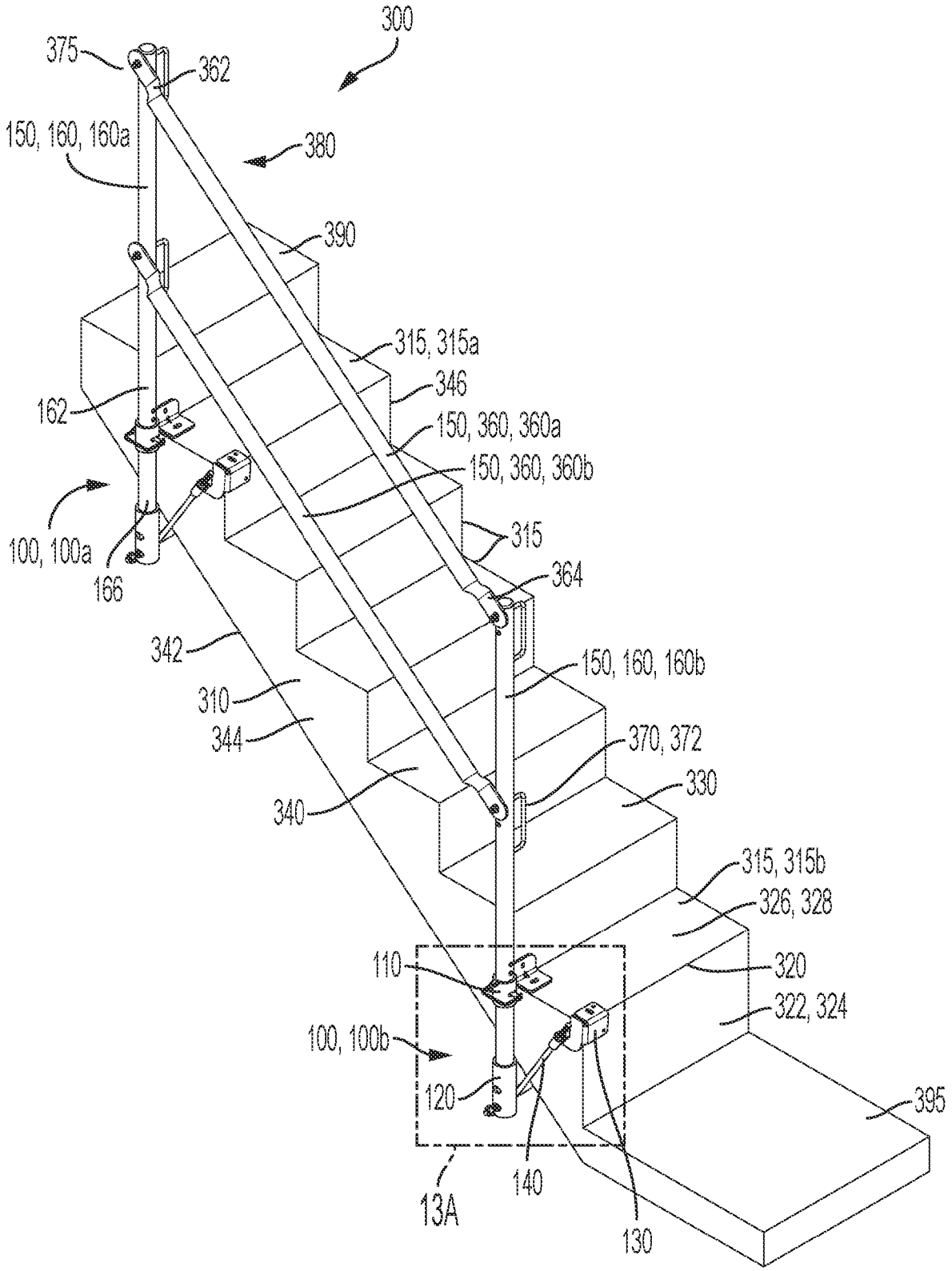
FIG. 3 is a perspective view of a staircase guardrail system in accordance with another aspect of the present disclosure, wherein the staircase guardrail system is mounted to a staircase, and wherein the staircase guardrail system comprises a plurality of the guardrail mounting brackets of FIG. 1 and a plurality of guardrail posts and lateral guardrails.

FIG. 3 illustrates a staircase guardrail system 300 mounted to the staircase 310, in accordance with a first aspect of the present disclosure. The staircase guardrail system 300 can comprise one or more of the guardrails 150 and one or more of the guardrail mounting brackets 100. According to example aspects, the guardrails 150 can comprise a plurality of the guardrail posts 160 and a plurality of lateral guardrails 360. The guardrail posts 160 can be oriented substantially vertically, as shown. In the present aspect, the guardrail posts 160 can comprise an upper guardrail post 160*a* and a lower guardrail post 160*b*, and the lateral guardrails 360 can comprise a top lateral guardrail 360*a* and a bottom lateral guardrail 360*b*. The top and bottom lateral guardrails 360*a,b* can extend laterally between the upper sections 162 of the upper and lower guardrail posts 160*a,b*, as shown. The lateral guardrails 360 can extend laterally in the sense that the can extend about horizontally or at an acute angle relative to horizontal between the guardrail posts 160. For example, in some aspects, the lateral guardrail 360 can be oriented at about 45° relative to horizontal. Each of the top and bottom lateral guardrails 360*a,b* can define an upper rail end 362 and a lower rail end 364. Each of the upper rail ends 362 can be directly or indirectly secured to the upper guardrail post 160*a* by a securing fastener 370, such as a securing pin 372, and each of the lower rail ends 364 can be directly or indirectly secured to the lower guardrail post 160*b* by another securing fastener 370, such as another securing pin 372. In other aspects, the lateral guardrails 360 can be secured to the guardrail posts 160 by any other suitable fastener(s) known in the art, such as screws, rivets, welding, and the like.

In the present aspect, the guardrail mounting brackets 100 can comprise an upper guardrail mounting bracket 100*a* coupling the upper guardrail post 160*a* to the staircase 310 and a lower guardrail mounting bracket 100*b* coupling the lower guardrail post 160*b* to the staircase 310. Securing the guardrails 150 to the staircase 310 can prevent movement thereof and ensure safe and proper functioning of the staircase guardrail system 300. As shown, the staircase 310 can extend between an upper slab 390 (e.g., an upper floor) and a lower slab 395 (e.g., a lower floor). Each of the upper slab 390 and lower slab 395 can be oriented substantially horizontally. The upper and lower slabs 390,395 can comprise concrete in some aspects. Furthermore, the staircase 310 can comprise concrete in some aspects. In other aspects, the staircase 310, the upper slab 390, and/or the lower slab 395 can comprise any other suitable material known in the art. The staircase 310 defines a top side 340, a bottom side 342 opposite the top side 340, a first lateral side 344, and a second lateral side 346 opposite the first lateral side 344. The staircase guardrail system 300 can be mounted to the staircase 310 at the first lateral side 344, as shown. In other aspects, the staircase guardrail system 300 can be mounted to the staircase 310 at the second lateral side 346.

The staircase 310 can comprise a plurality of the stairs 315 defined at the top side 340 of the staircase 310, which can allow a user (e.g., a worker at a construction site) to climb from the lower slab 395 to the upper slab 390, and vice versa. Each of the stairs 315 can define a substantially vertical riser 322 and a substantially horizontal tread 326. Each vertical riser 322 can meet the corresponding horizontal tread 326 at the upper front edge 320 of the corresponding stair 315. The tread 326 of each stair 315 can define a substantially horizontal tread surface 328, and the riser 322 of each stair 315 can define a substantially vertical riser surface 324. The horizonal tread surfaces 328 and the vertical riser surfaces 324 of the stairs 315 can together define the upper staircase surface 330. Additionally, each of the stairs 315 can define a lower stair surface 1334 (shown in FIG. 13B) at the bottom side 342 of the staircase 310. The lower stair surfaces 1334 of the stairs 315 can together define the lower staircase surface 1332, which can extend from the upper slab 390 to the lower slab 395 at the bottom side 342 of the staircase 310. In some example aspects, the lower stair surfaces 1334 can be substantially coplanar, such that the lower staircase surface 1332 can be substantially planar. In other aspects, lower stair surfaces 1334 may not be coplanar, and thus, the lower staircase surface 1332 may not be planar.

An upper stair 315*a* of the stairs 315 can connect the staircase 310 to the upper slab 390 and a lower stair 315*b* of the stairs 315 can connect the staircase 310 to the lower slab 395. In the present aspects, the upper guardrail mounting bracket 100*a* can be attached to the upper stair 315*a* and the lower guardrail mounting bracket 100*b* can be attached to the lower stair 315*b*. Each of the upper and lower guardrail posts 160*a,b* can be coupled to and can extend substantially vertically upward from the corresponding upper and lower guardrail mounting brackets 100*a,b*, respectively. In example aspects, the intermediate section 166 of each guardrail post 160 can extend along the first lateral side 344 of the staircase 310, the upper section 162 can extend upward from the intermediate section 166 beyond the top side 340 of the staircase 310, and the lower section 564 (shown in FIG. 5A) can extend downward from the intermediate section 166 beyond the bottom side 342 of the staircase 310. The upper sections 162 of the guardrail posts 160 can be elongated to position the lateral guardrails 360 at a suitable height above the staircase 310 to prevent falls over the first lateral side 344 of the staircase 310 and to allow the user to grip one or both of the lateral guardrails 360 as they climb the staircase 310.

Each of the guardrail mounting brackets 100 can comprise the upper clamping bracket 110, the lower clamping bracket 120, and the front clamping bracket 130. Each of the upper clamping brackets 110 can engage the upper staircase surface 330, and specifically, can engage the horizontal tread surface 328 of the corresponding stair 315. Each of the lower clamping brackets 120 can engage the lower staircase surface 1332, and specifically, can engage the lower stair surface 1334 of the corresponding stair 315. In other aspects, each of the lower clamping brackets 120 can engage the lower stair surface 1334 of a different one of the stairs 315 (e.g., an adjacent stair 315.) Furthermore, the front clamping bracket 130 can engage the upper front edge 320 of the corresponding stair 315. Referring specifically to the lower guardrail mounting bracket 100*b*, the upper clamping bracket 110 can engage the horizontal tread surface 328 of the lower stair 315*b*, the lower clamping bracket 120 can engage the lower stair surface 1334 of the lower stair 315*b*, and the front clamping bracket 130 can engage the upper front edge 320 of the lower stair 315*b*. Thus, the lower stair 315*b* can be clamped between the upper clamping bracket 110, lower clamping bracket 120, and the front clamping bracket 130 to secure the lower guardrail mounting bracket 100*b* to the lower stair 315*b*. The upper guardrail mounting bracket 100*a* can be secured to the upper stair 315*a* in the same way, and the staircase guardrail system 300 can thereby be secured to the staircase 310. Other aspects of the guardrail system 300 can comprise additional or fewer guardrail mounting brackets 100 and/or guardrails 150. Additionally, in other aspects, a second staircase guardrail system 300 can be mounted at the second lateral side 346 of the staircase 310 to prevent falls over the second lateral side 346 of the staircase 310. In some aspects, any or all of the upper clamping bracket 110, the lower clamping bracket 120, and the front clamping bracket 130 can be bolted to the staircase 310. For example, in some aspects, the staircase 310 can comprise concrete, and the upper clamping bracket 110, the lower clamping bracket 120, and/or the front clamping bracket 130 can be bolted to the concrete staircase 310.

Figure 4:
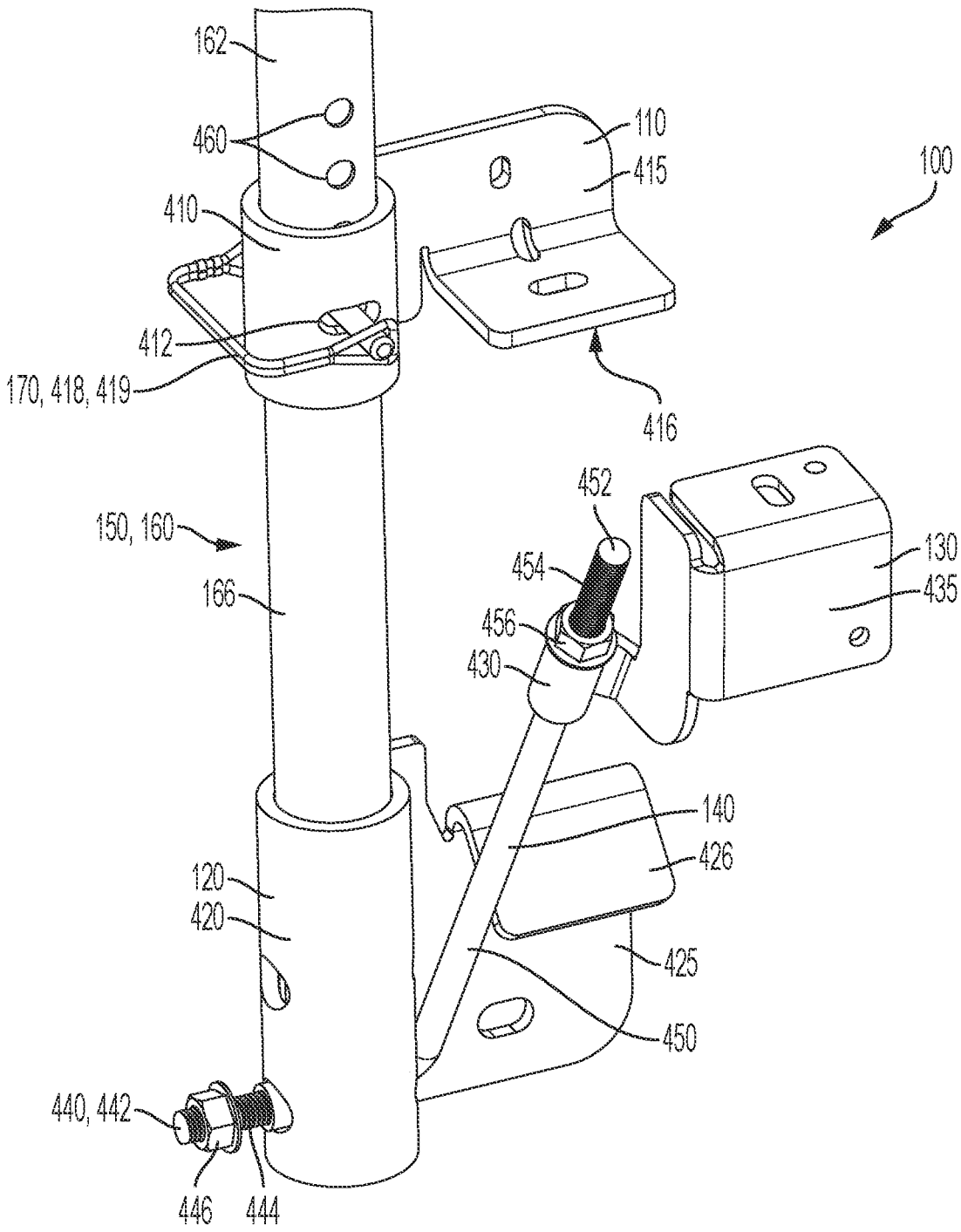
FIG. 4 is a perspective view of the guardrail mounting bracket of FIG. 1 mounted to the guardrail of FIG. 1.

FIG. 4 illustrates a close up view of the guardrail mounting bracket 100 coupled to the guardrail post 160. The guardrail mounting bracket 100 can comprise the upper clamping bracket 110 and the lower clamping bracket 120 mounted on the guardrail post 160, and can further comprise the front clamping bracket 130 pivotably coupled to the lower clamping bracket 120 by the connector bolt 140. As described in further detail below, each of the upper and lower clamping brackets 110,120 can be repositioned along the guardrail post 160 to accommodate stairs 315 of varying sizes and to securely clamp the staircase 310 therebetween. In other aspects, either or both of the upper and lower clamping brackets 110,120 may not be repositionable along the guardrail post 160.

According to example aspects, the upper clamping bracket 110 can define an upper post engagement portion 410 and an upper stair engagement portion 415 extending from the upper post engagement portion 410. The upper stair engagement portion 415 can extend laterally from the upper post engagement portion 410 and can define an upper stair engagement surface 416 that can abut the upper staircase surface 330 (shown in FIG. 3) of the staircase 310 (shown in FIG. 3) when the guardrail mounting bracket 100 is mounted to the staircase 310. In example aspects, the upper clamping bracket 110 can be monolithically formed (i.e., formed a singular component that constitutes a single material without joints or seams). In other aspects, the upper clamping bracket 110 may not be monolithically formed. In the present aspect, the upper clamping bracket 110 can be formed by laser-cutting and bending steel plates. However, in other aspects, the upper clamping bracket 110 may not be monolithically formed and/or may be manufactured using other desired methods, such as stamping, casting, or machining The upper post engagement portion 410 can be substantially tubular and can be configured to receive the guardrail post 160 therethrough. Specifically, a portion of the upper section 162 of the guardrail post 160 can extend through an upper rail channel 610 (shown in FIG. 6A) of the upper post engagement portion 410. A positioning fastener 418, such as a positioning pin 419, can extend transversely through the upper post engagement portion 410 and the guardrail post 160 to secure the upper clamping bracket 110 to the guardrail post 160 at a desired position. In the present aspect, the storage fastener 170 can be repurposed as the positioning fastener 418. In other aspects, however, the positioning fastener 418 may not be the storage fastener 170. In other aspects, the positioning fastener 418 can be any other suitable type of pin or fastener known in the art, such as a nut and bolt assembly or the like. The positioning pin 419 can extend through an upper clamp opening 412 of the upper post engagement portion 410 and through a corresponding upper positioning opening 460 of the guardrail post 160 to couple the upper clamping bracket 110 to the guardrail post 160. In example aspects, a plurality of the upper positioning openings 460 can be spaced vertically along the upper section 162 of the guardrail post 160 to allow to upper clamping bracket 110 to be repositioned thereon. According to example aspects, the upper clamping bracket 110 can be repositionable along the upper section 162 between at least a first position and a second position. In the first position, the upper clamping bracket 110 can be spaced from the lower clamping bracket 120 by a first distance, and in the second position, the upper clamping bracket 110 can be spaced from the lower clamping bracket 120 by a second distance, wherein the second distance can be greater than the first distance.

Example aspects of the lower clamping bracket 120 can define a lower post engagement portion 420 and a lower stair engagement portion 425 extending from the lower post engagement portion 420. In example aspects, the lower clamping bracket 120 can be monolithically formed, as shown. In some aspects, the lower clamping bracket 120 can be formed by laser-cutting and bending steel plates. However, in other aspects, the lower clamping bracket 120 may not be monolithically formed and/or may be manufactured using other desired methods, such as stamping, casting, or machining. The lower post engagement portion 420 can be substantially tubular and can be configured to receive the guardrail post 160 therein, and in some aspects therethrough. Specifically, a portion of the lower section 564 (shown in FIG. 5A) of the guardrail post 160 can extend into, and in some instances can extend through, a lower rail channel 720 (shown in FIG. 7) of the lower post engagement portion 420. In the present aspect, the lower post engagement portion 420 can be slidably mounted on the guardrail post 160 and can be secured thereto by the connector bolt 140. The lower stair engagement portion 425 can extend laterally from the lower post engagement portion 420 and can define a lower stair engagement surface 426 that can abut the lower staircase surface 1332 (shown in FIG. 13B) of the staircase 310 when the guardrail mounting bracket 100 is mounted to the staircase 310.

According to example aspects, the front clamping bracket 130 can define a connector engagement portion, such as a bolt engagement portion 430, configured to couple the front clamping bracket 130 to the connector (e.g., the connector bolt 140). The front clamping bracket 130 can further define a front stair engagement portion 435 extending from the bolt engagement portion 430. In the present aspect, the front clamping bracket 130 can be monolithically formed; however, in other aspects, the front clamping bracket 130 may not be monolithically formed. Furthermore, in the present aspect, the front clamping bracket 130 can be formed by laser-cutting and bending steel plates. However, in other aspects, the front clamping bracket 130 may not be monolithically formed and/or may be manufactured using other desired methods, such as stamping, casting, or machining. The bolt engagement portion 430 can be substantially tubular and can be configured to receive a portion of the connector bolt 140 therethrough. The bolt engagement portion 430 can be slidable along the connector bolt 140 to selectively position the front clamping bracket 130 closer to or further from the lower clamping bracket 120. The front stair engagement portion 435 can extend laterally from the bolt engagement portion 430 and can be configured to engage the riser 322 and the tread 326 of the corresponding stair 315 at the upper front edge 320 thereof when the guardrail mounting bracket 100 is mounted to the staircase 310 (staircase 310, stair 315, upper front edge 320, riser 322, and tread 326 shown in FIG. 3).

Example aspects of the connector bolt 140 can be substantially L-shaped can define a lower arm 440 and an upper arm 450. The lower arm 440 can define a first bolt end 442 and the upper arm 450 can define an opposite second bolt end 452. As shown, the lower arm 440 can extend transversely through the lower post engagement portion 420 of the lower clamping bracket 120 and the guardrail post 160 to couple the lower clamping bracket 120 to the guardrail post 160. The upper arm 450 can extend through the bolt engagement portion 430 of the front clamping bracket 130 to mount the front clamping bracket 130 thereon. The lower arm 440 can define a first threaded portion 444 proximate to the first bolt end 442, and the upper arm 450 can define a second threaded portion 454 proximate to the second bolt end 452. A first threaded nut 446 can be rotationally mounted on the first threaded portion 444 to secure the connector bolt 140 to the lower clamping bracket 120 and the guardrail post 160. A tightening fastener, such as a second threaded nut 456, can be rotationally mounted on the second threaded portion 454 to secure the front clamping bracket 130 to the connector bolt 140. The second threaded nut 456 can be selectively loosened and tightened along the second threaded portion 454 to adjust the position of the front clamping bracket 130 along the upper arm 450 of the connector bolt 140, as described in further detail below.

Figure 5A:
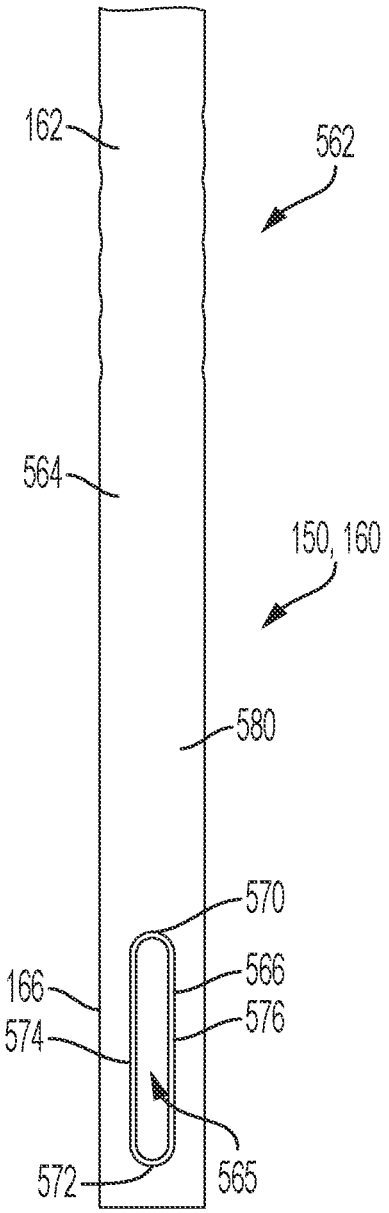
FIG. 5A is a side view of the guardrail post of FIG. 1.
Figure 5B:
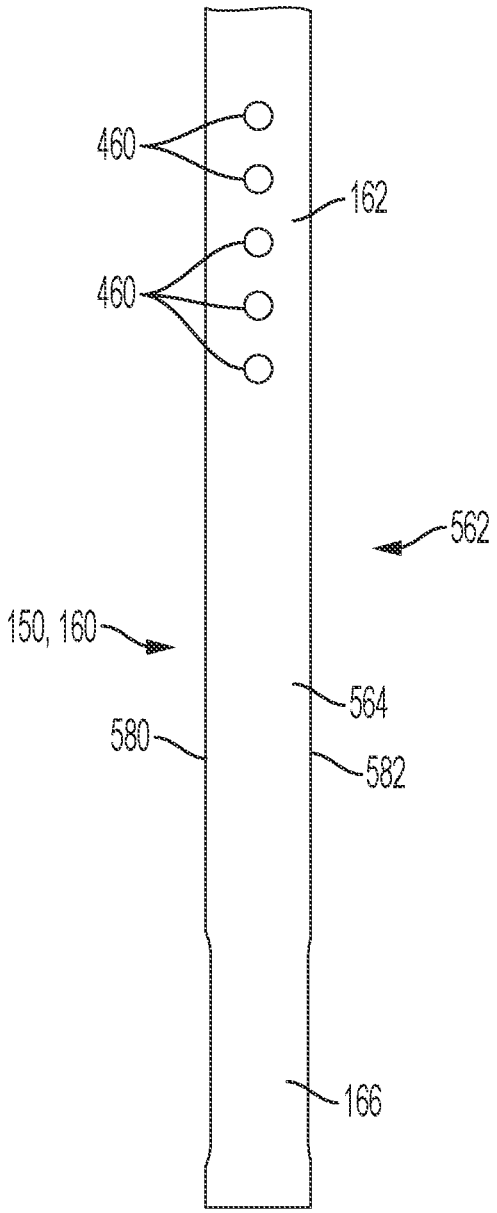
FIG. 5B is a front view of the guardrail post of FIG. 1.

FIGS. 5A and 5B illustrate side and front views, respectively, of a lower portion 562 of the guardrail post 160. The guardrail post 160 can define the upper section 162, the lower section 564, and the intermediate section 166 extending between the upper section 162 and the lower section 564. Referring to FIG. 5A, as shown, the lower section 564 of the guardrail post 160 can define a substantially guardrail post slot 565 defined therethrough. The guardrail post slot 565 can define an outer slot 566 formed through a first rail side 580 of the guardrail post 160 and a corresponding inner slot 1068 (shown in FIG. 10) formed through an opposing second rail side 582 (shown in FIG. 5B) of the guardrail post 160. Furthermore, each of the inner slot 1068 and the outer slot 566 can define an upper slot end 570, a lower slot end 572 opposite the upper slot end 570, a first slot side 574, and a second slot side 576 opposite the first slot side 574. The lower arm 440 (shown in FIG. 4) of the connector bolt 140 (shown in FIG. 1) can extend transversely through the guardrail post slot 565 can slide vertically therein. Referring to FIG. 5B, the plurality of upper positioning openings 460 can be defined through the upper section 162 of the guardrail post 160. The upper positioning openings 460 can be spaced vertically along the guardrail post 160 proximate to the intermediate section 166 of the guardrail post 160. The positioning pin 419 (shown in FIG. 4) can be selectively engaged with a desired one of the upper positioning openings 460 to reposition the upper clamping bracket 110 (shown in FIG. 1) at a desired location along the guardrail post 160.

Figure 6A:
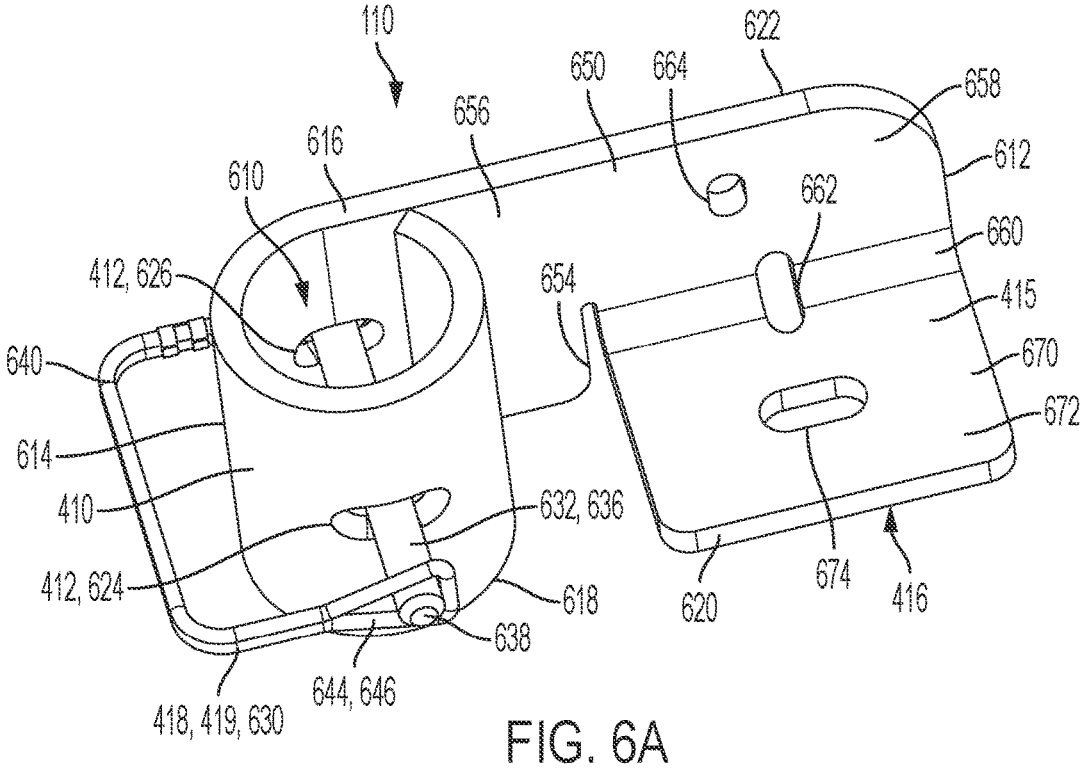
FIG. 6A is a front perspective view of an upper clamping bracket of the guardrail mounting bracket of FIG. 1.
Figure 6B:
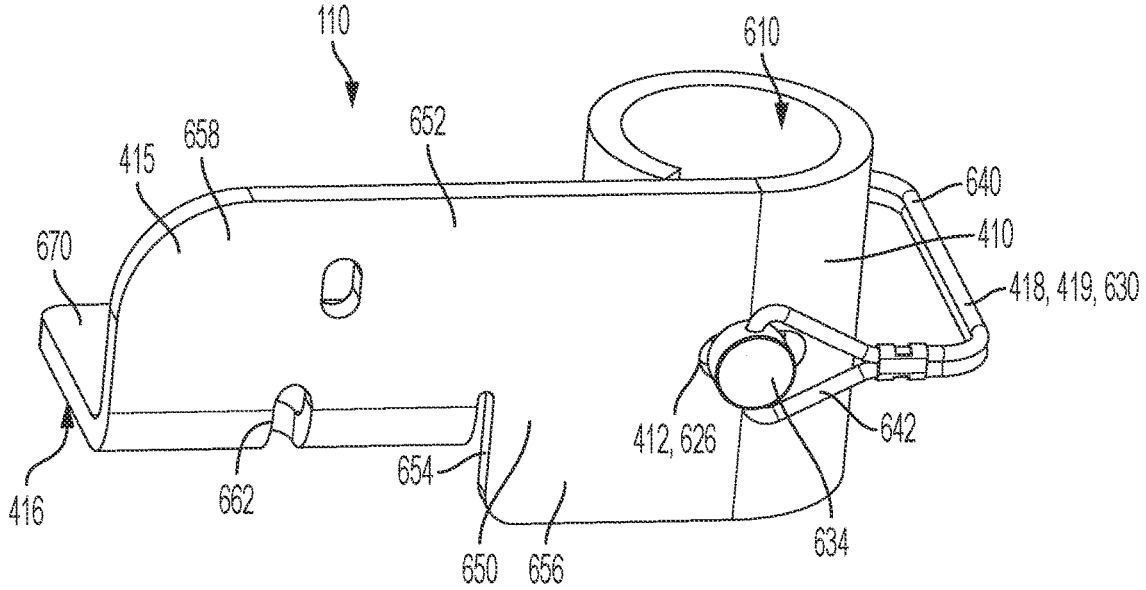
FIG. 6B is a rear perspective view of the upper clamping bracket of FIG. 6A.

FIGS. 6A and 6B illustrates front and rear perspective view of the upper clamping bracket 110, in accordance with an example aspect of the present disclosure. Referring to FIG. 6, the upper clamping bracket 110 can define a first end 612, a second end 614 opposite the first end 612, an upper end 616, a lower end 618 opposite the upper end 616, a front side 620, and a rear side 622 opposite the front side 620. The upper stair engagement portion 415 can be defined generally at the first end 612 and the upper post engagement portion 410 can be defined generally at the second end 614. The upper post engagement portion 410 can be monolithically formed with the upper stair engagement portion 415 in the present aspect. The upper post engagement portion 410 can be substantially tubular and can define the upper rail channel 610 therethrough. In some aspects, the upper clamping bracket 110 can be bent into a tubular shape at the second end 614 to define the upper post engagement portion 410 and the upper rail channel 610. The upper section 162 of a corresponding guardrail post 160 (shown in FIG. 1) can extend through the upper rail channel 610. The upper clamp opening 412 can extend through the upper post engagement portion 410, transversely across the upper rail channel 610 and generally from the front side 620 to the rear side 622, as shown. The upper clamp opening 412 can define a first opening 624 formed through the upper post engagement portion 410 at the front side 620 of the upper clamping bracket 110 and a second opening 626 formed the upper post engagement portion 410 at the rear side 622 of the upper clamping bracket 110.

As described above, the upper section 162 (shown in FIG. 1) of the guardrail post 160 can define the upper positioning openings 460 (shown in FIG. 4). A desired one of the upper positioning openings 460 can be aligned with the upper clamp opening 412, and the positioning pin 419 can extend through the upper clamp opening 412 and the corresponding upper positioning opening 460 to position and secure the upper clamping bracket 110 to the guardrail post 160. In some aspects, the positioning pin 419 can be a positioning lock pin 630, as shown. The positioning pin 419 can define a straight pin rod 632 and a substantially D-shaped pin lock 640. In other aspects, the pin lock 640 can be substantially C-shaped or can define any other suitable shape. The pin rod 632 can define a pin head 634 (shown in FIG. 6B) and a pin tail 636 extending therefrom. The pin head 634 can be configured to abut the upper post engagement portion 410 at the rear side 622, external to the upper rail channel 610. The pin tail 636 can extend through the upper clamp opening 412, such that a distal tail end 638 of the pin tail 636 can extend outward from the upper post engagement portion 410 at the front side 620. When the upper clamping bracket 110 is mounted to the guardrail post 160, the pin tail 636 can further extend through the corresponding upper positioning opening 460 aligned with upper clamp opening 412, thereby selectively fixing the upper clamping bracket 110 in position relative to the guardrail post 160. In other aspects, the orientation of the positioning pin 419 can be reversed, such that the pin head 634 can abut the upper post engagement portion 410 at the front side 620 and the distal tail end 638 can extend outward beyond the rear side 622.

Furthermore, the pin lock 640 can be oriented in a locked configuration, as shown, to prevent accidental removal or dislodging of the positioning pin 419 from the upper clamp opening 412. In some aspects, the pin lock 640 can be formed from a flexible wire to allow the pin lock 640 to be flexibly moved between the locked configuration and an unlocked configuration. The pin lock 640 can define a first lock end 642 (shown in FIG. 6B) coupled to the pin head 634 and a second lock end 644 oriented proximate to the distal tail end 638 of the pin tail 636. The flexible wire of the pin lock 640 at the first lock end 642 can extend through a hole in the pin head 634 to couple the pin lock 640 to the pin head 640, and the pin lock 640 can extend therefrom around an outside of the upper post engagement portion 410. A locking loop 646 or locking hook can be defined at the second lock end 644 of the pin lock 640. To secure the pin lock 640 in the locked configuration, the locking loop 646 can be hooked onto the distal tail end 638 of the pin tail 636 to prohibit the pin tail 636 from disengaging the upper clamp opening 412.

The upper stair engagement portion 415 of the upper clamping bracket 110 can define an upper extension wall 650 extending laterally from the upper post engagement portion 410 to the first end 612 of the upper clamping bracket 110 at the rear side 622 thereof. The upper extension wall 650 can be oriented substantially vertically in the present aspect. The substantially vertical upper extension wall 650 can define a substantially vertical wall surface 652 (shown in FIG. 6B) facing the rear side 622 of the upper clamping bracket 110. An upper engagement wall 670 can extend from the vertical upper extension wall 650 towards the front side 620 of the upper clamping bracket 110. The upper engagement wall 670 can be oriented substantially horizontally in the present aspect, such that the upper engagement wall 670 can be oriented at about 90° (i.e., about perpendicular) relative to the upper extension wall 650. In example aspects, an upper wall slot 654 can extend into the vertical upper extension wall 650 generally at the lower end 618. The vertical upper extension wall 650 can define a first upper wall section 656 extending from the upper post engagement portion 410 to the upper wall slot 654, and a second upper wall section 658 extending from the upper wall slot 654 to the first end 612. As shown, the upper clamping bracket 110 can be bent at a lower wall end 660 of the second upper wall section 658, adjacent to the upper wall slot 654, to define the horizontal upper engagement wall 670. In some aspects, a relief hole 662 can be formed at the junction between the vertical upper extension wall 650 and the horizontal upper engagement wall 670 to facilitate bending the horizontal upper engagement wall 670 relative to the vertical upper extension wall 650. Furthermore, in some aspects an upper wall opening 664 can be formed through the second upper wall section 658 of the vertical upper extension wall 650. Example aspects of the horizontal upper engagement wall 670 can define the upper stair engagement surface 416 generally facing towards the lower end 618 of the upper clamping bracket 110, and can further define an upper wall surface 672 opposite the upper stair engagement surface 416 and generally facing towards the upper end 616 of the upper clamping bracket 110. In example aspects, a first retaining opening 674 can be formed through the horizontal upper engagement wall 670, as shown. As described above, in some aspects, the upper clamping bracket 110 can be bolted to the staircase 310. For example, in some aspects, the staircase 310 can comprise concrete, and the upper clamping bracket 110 can be bolted thereto with concrete anchor bolts. A concrete anchor bolt can extend through the upper wall opening 664 to bolt the upper clamping bracket 110 to the adjacent riser 322. In some aspects, another concrete anchor bolt can extend through the first retaining opening 674 to bolt the upper clamping bracket to the corresponding tread 326.

Figure 7:
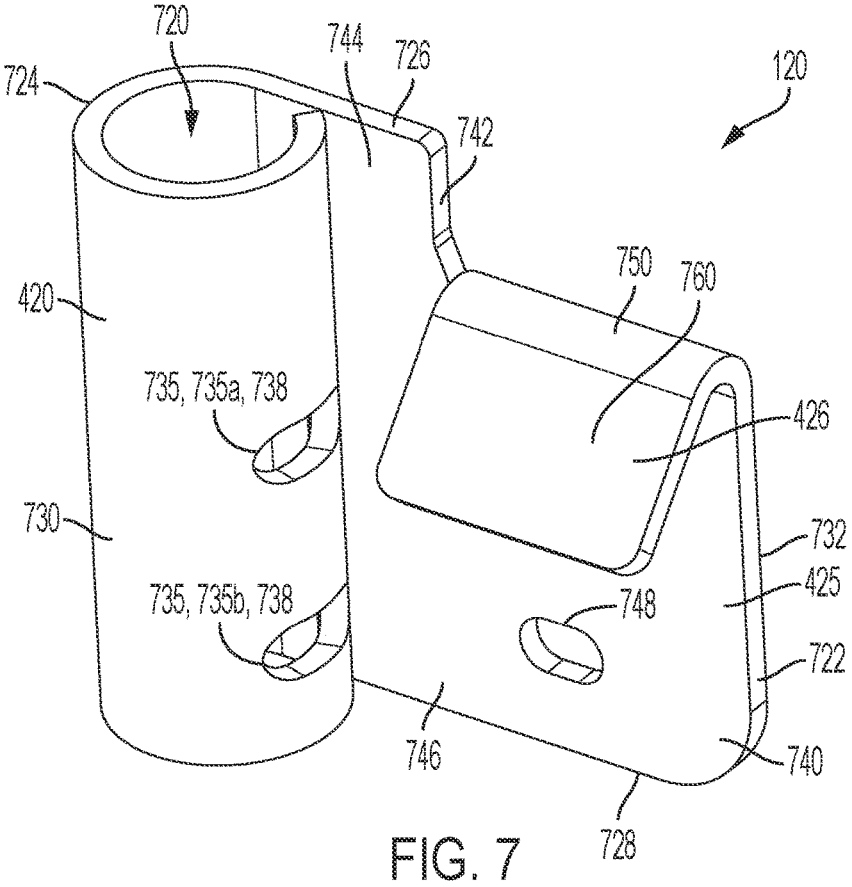
FIG. 7 is a front perspective view of a lower clamping bracket of the guardrail mounting bracket of FIG. 1.

FIG. 7 illustrates the lower clamping bracket 120 in accordance with an example aspect of the present disclosure. The lower clamping bracket 120 can define a first end 722, a second end 724 opposite the first end 722, an upper end 726, a lower end 728 opposite the upper end 726, a front side 730, and a front side 732 opposite the front side 730. The lower stair engagement portion 425 can be defined generally at the first end 722 and the lower post engagement portion 420 can be defined generally at the second end 724. The lower post engagement portion 420 can be monolithically formed with the lower stair engagement portion 425 in the present aspect. As shown, the lower post engagement portion 420 can be substantially tubular and can define the lower rail channel 720 therethrough. In some aspects, the lower clamping bracket 120 can be bent into a tubular shape at the second end 724 to define the lower post engagement portion 420 and the lower rail channel 720. The lower section 564 of a corresponding guardrail post 160 (shown in FIG. 1) can extend into, and in some aspects can extend through, the lower rail channel 720. In example aspects, one or more lower clamp openings 735 can be defined through the lower post engagement portion 420, extending transversely across the lower rail channel 720 and generally from the second end 724 towards the first end 722, as shown. For example, the lower clamp openings 735 can comprise a top lower clamp opening 735*a* and a bottom lower clamp opening 735*b* vertically spaced from the top lower clamp opening 735*a*. Each of the lower clamp openings 735 can define an outer opening 936 (shown in FIG. 9) formed through the lower post engagement portion 420 at the second end 724 and an inner opening 738 formed through the lower post engagement portion 420 opposite the outer opening 936.

The lower stair engagement portion 425 of the lower clamping bracket 120 can define a lower extension wall 740 extending laterally from the lower post engagement portion 420 to the first end 722 of the lower clamping bracket 120 at the front side 732 thereof. The lower extension wall 740 can be oriented substantially vertically in the present aspect. A lower engagement wall 760 can extend from the substantially vertical lower extension wall 740. In the present aspect, the lower engagement wall 760 can extend generally forward and downward from the vertical lower extension wall 740 and can be oriented at an acute angle thereto. In other aspects, the lower engagement wall 760 can be oriented horizontally or at any suitable angle relative to the vertical lower extension wall 740. In example aspects, a lower wall slot 742 can extend into the vertical lower extension wall 740 generally at the upper end 726. The vertical lower extension wall 740 can define a first lower wall section 744 extending from the lower post engagement portion 420 to the lower wall slot 742, and a second lower wall section 746 extending from the lower wall slot 742 to the first end 722. In some aspects, a lower wall opening 748 can be formed through the second lower wall section 746. In some aspects, depending upon the profile of the lower staircase surface 1332, the lower clamping bracket 120 may be bolted to the staircase 310. A bolt, such as a concrete anchor bolt for example, can extend through the lower wall opening 748 to bolt the lower clamping bracket 120 to the lower staircase surface 1332.

As shown, the lower clamping bracket 120 can be bent at an upper wall end 750 of the second lower wall section 746, adjacent to the lower wall slot 742, to define the lower engagement wall 760. The lower engagement wall 760 can define the lower stair engagement surface 426, which can face substantially forward and upward from the vertical lower extension wall 740. According to example aspects, the angle of the lower engagement wall 760 relative to the vertical lower extension wall 740 (in this case, an acute angle) can substantially match an angle of the lower staircase surface 1332 (shown in FIG. 13B) relative to vertical. For example, in some aspects, the angle of the lower staircase surface 1332 relative to vertical can be about 45°. In other aspects, the angle of the lower staircase surface 1332 relative to vertical can be greater or less than 45°.

Figure 8:
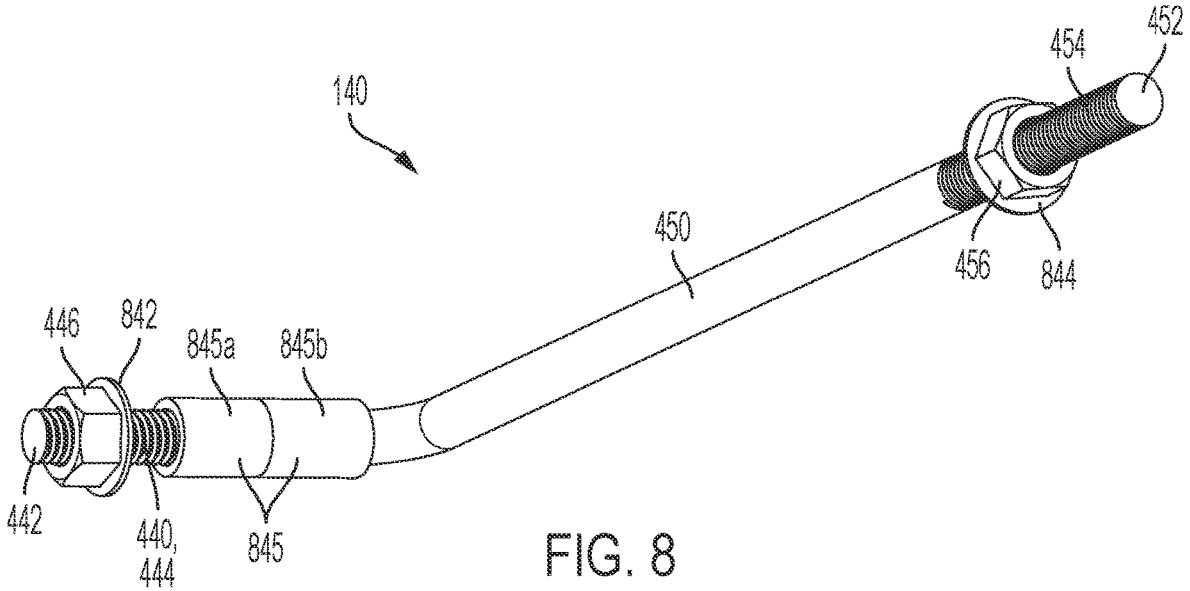
FIG. 8 is a perspective view of a connector bolt of the guardrail mounting bracket of FIG. 1.

FIG. 8 illustrates the connector bolt 140 in accordance with an example aspect of the invention. The connector bolt 140 can be substantially L-shaped and can define the lower arm 440 and the upper arm 450 extending from and oriented about perpendicular to the lower arm 440. The upper arm 450 can be elongate and can define a length that can be greater than a length of the lower arm 440. The lower arm 440 can define the first bolt end 442 distal to the upper arm 450, and the upper arm 450 can define the second bolt end 452 distal to the lower arm 440. Furthermore, the lower arm 440 can define the first threaded portion 444, and the upper arm 450 can define the second threaded portion 454. The first threaded nut 446 and a first washer 842 can be mounted on the first threaded portion 444 of the lower arm 440, wherein the first threaded nut 446 can be oriented between the first bolt end 442 and the first washer 842. Similarly, the tightening fastener (e.g., the second threaded nut 456) and a second washer 844 can be mounted on the second threaded portion 454 of the upper arm 450, wherein the second threaded nut 456 can be oriented between the second bolt end 452 and the second washer 844. In other aspects, either or both of the first and second washer 842,844 can be an integrated washer monolithically formed with or coupled to the connector bolt 140. Other aspects of the connector bolt 140 may not comprise the first washer 842 and/or the second washer 844. Example aspects of the connector bolt 140 can further comprise one or more spacers 845 mounted on the lower arm 440 between the first washer 842 and the upper arm 450. For example, in the present aspect, a first spacer 845*a* and a second spacer 845*b* can be mounted on the lower arm 440. The spacers 845 can be substantially cylindrical, as shown. In other aspects, the connector bolt 140 can comprise more or fewer spacers 845 and/or the spacers 845 can define any other suitable shape or configuration.

Figure 9:
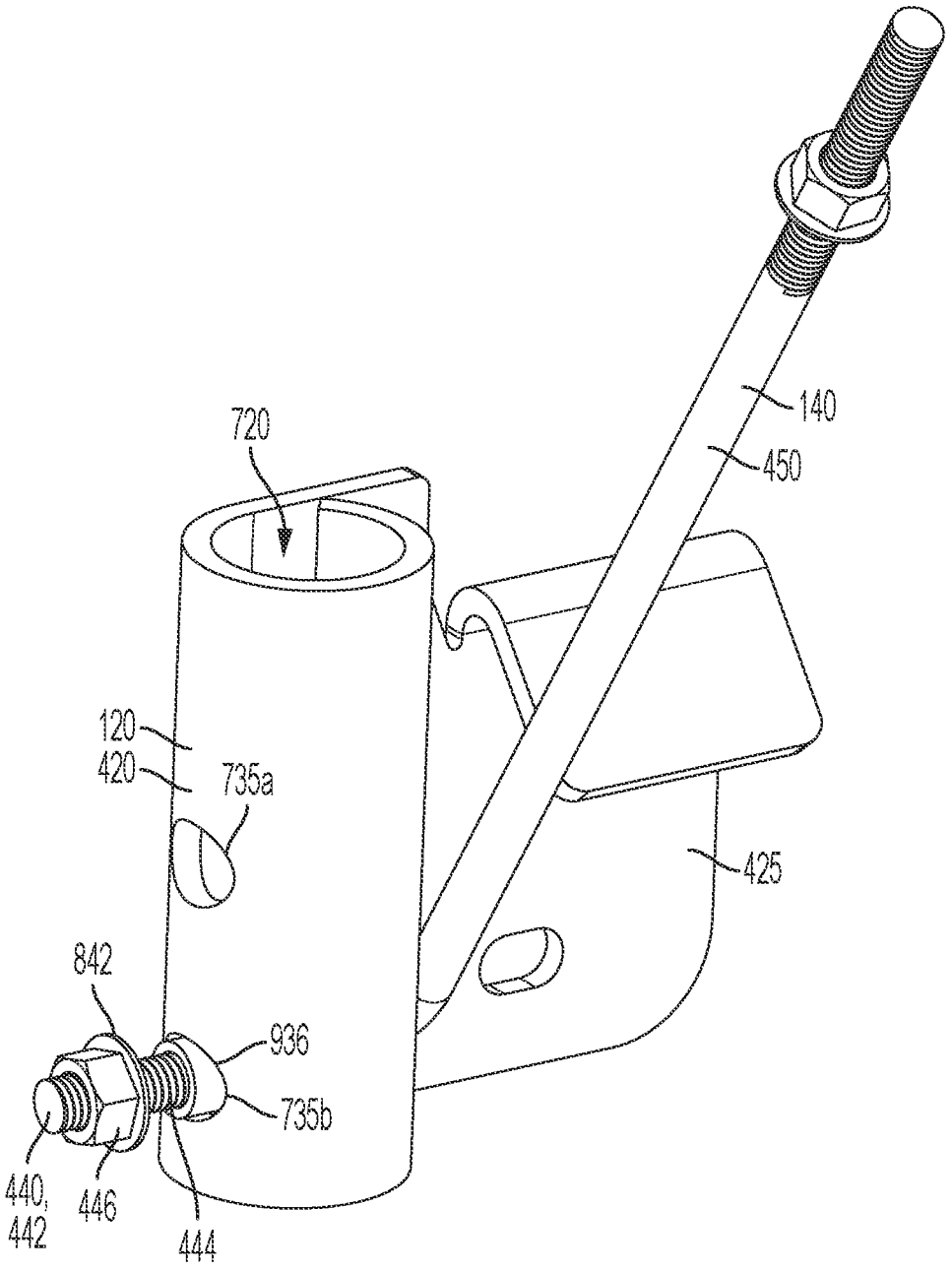
FIG. 9 is a perspective view of the connector bolt of FIG. 8 assembled with the lower clamping bracket of FIG. 7.

FIG. 9 illustrates the connector bolt 140 assembled with the lower clamping bracket 120. The lower arm 440 of the connector bolt 140 can extend through one of the top lower clamp opening 735*a* and the bottom lower clamp opening 735*b*, depending upon the desired positioning of the lower clamping bracket 120 relative to the upper clamping bracket 110 (shown in FIG. 1). In the present aspect, the lower arm 440 can extend through the bottom lower clamp opening 735*b*, as shown. With the lower arm 440 extending through the bottom lower clamp opening 735*b*, the lower clamping bracket 120 can be positioned closer to the upper clamping bracket 110 when assembled with the guardrail post 160 (shown in FIG. 1). In aspects wherein the lower arm 440 extends through the top lower clamp opening 735*a*, the lower clamping bracket 120 can be spaced further from the upper clamping bracket 110 to accommodate stairs 315 having a greater height. The lower arm 440 can extend through the inner opening 738 (shown in FIG. 7) of the bottom lower clamp opening 735*b*, transversely across the lower rail channel 720, and through the outer opening 936 of the bottom lower clamp opening 735*b*. The first bolt end 442 of the lower arm 440 can extend beyond the outer opening 936, and the first threaded nut 446 and first washer 842 can be mounted thereon, external to the lower rail channel 720. The first threaded nut 446 can be tightened on the first threaded portion 444 as needed.

Figure 10:
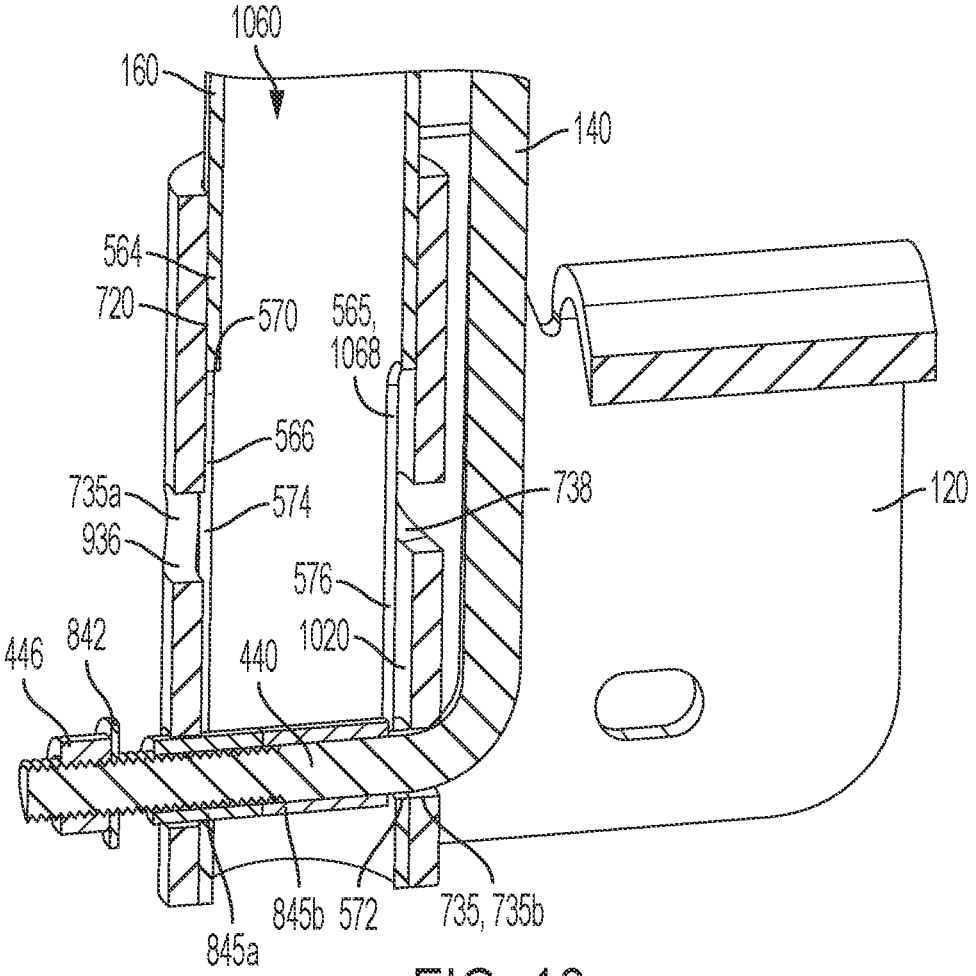
FIG. 10 is a cross-sectional view of the connector bolt of FIG. 8 assembled with the lower clamping bracket of FIG. 7 and the guardrail of FIG. 1, taken along line 10-10 in FIG. 1.

FIG. 10 illustrates a cross-sectional view of the connector bolt 140 assembled with the lower clamping bracket 120 and the guardrail post 160, taken along line 10-10 in FIG. 1. As shown, the lower section 564 of the guardrail post 160 can extend into, and in some aspects can extend fully through, the lower rail channel 720 of the lower clamping bracket 120. The guardrail post slot 565 of the guardrail post 160 can be aligned with the corresponding lower clamp opening 735 through which the connector bolt 140 extends, which in the present aspect can be the bottom lower clamp opening 735*b*. Thus, the lower arm 440 of the connector bolt 140 can further extend through the guardrail post slot 565, transversely across a guardrail channel 1060 of the guardrail post 160. The lower clamping bracket 120 can be configured to slide vertically along the lower section 564 of the guardrail post 160. As lower clamping bracket 120 slides along the guardrail post 160, the lower arm 440 of the connector bolt 140 can slide vertically with the guardrail post slot 565. According to example aspects, the upper slot end 570 and the lower slot end 572 of the guardrail post slot 565 can be configured to engage the lower arm 440 to limit the vertical movement of the lower clamping bracket 120 along the guardrail post 160.

According to example aspects, each of the first spacer 845*a* and the second spacer 845*b* can be positioned at least partially with the guardrail channel 1060. As shown, the first spacer 845*a* can be oriented partially within the guardrail channel 1060 and can extend through the outer slot 566 of the guardrail post slot 565 and through the outer opening 936 of the bottom lower clamp opening 735*b*. The first spacer 845*a* can be configured to substantially fill the clearance between the lower arm 440 and the outer opening 936, as well as the clearance between the lower arm 440 and the first and second slot sides 574,576 of the outer slot 566. The second spacer 845*b* can be oriented adjacent to the first spacer 845*a* and can be positioned fully within the guardrail channel 1060. As the first threaded nut 446 and the first washer 842 are tightened on the first threaded portion 444 of the lower arm 440, the first washer 842 can push against the first spacer 845*a* to slide the first and second spacers 845*a,b* along the lower arm 440 towards the second rail side 582. The second spacer 845*b* can be biased into engagement with the inner slot 1068 of the guardrail post 160 and can abut an inner surface 1020 of the lower post engagement portion 420 adjacent to the inner opening 738 of the bottom lower clamp opening 735*b*. The first and second spacers 845*a,b* can thereby serve to tighten the assembly of the connector bolt 140, the lower clamping bracket 120, and the guardrail post 160, reducing looseness and wobbling between the components. Furthermore, in example aspects, the lower arm 440 of the connector bolt 140 can be rotatable within the spacers 845, such that the spacers 845 can act as bearings to allow the connector bolt 140 to pivot relative to the lower clamping bracket 120 and the guardrail post 160.

Figure 11:
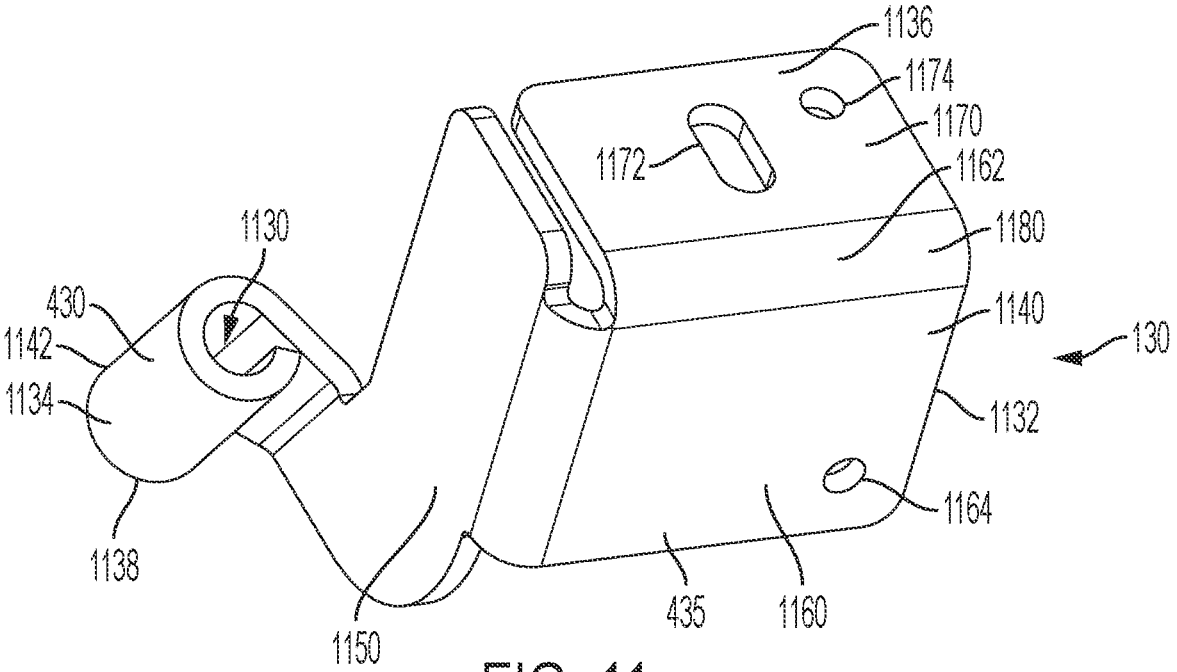
FIG. 11 is a perspective view of a front clamping bracket of the guardrail mounting bracket of FIG. 1.

FIG. 11 illustrates the front clamping bracket 130 in accordance with an example aspect of the present disclosure. The front clamping bracket 130 can comprise the tubular bolt engagement portion 430 and the front stair engagement portion 435 extending from the bolt engagement portion 430. Additionally, the front clamping bracket 130 can generally define a first end 1132, a second end 1134 opposite the first end 1132, an upper end 1136, a lower end 1138 opposite the upper end 1136, a front side 1140, and a front side 1142 opposite the front side 1140. The bolt engagement portion 430 can be monolithically formed with the front stair engagement portion 435 in the present aspect. The front stair engagement portion 435 can be defined generally at the first end 1132 and the bolt engagement portion 430 can be defined generally at the second end 1134. The bolt engagement portion 430 can further be oriented generally proximate to the lower end 1138 and the front side 1142. The bolt engagement portion 430 can define a bolt channel 1130, which can be configured to receive the upper arm 450 of the connector bolt 140 (shown in FIG. 1) therethrough. In some aspects, the front clamping bracket 130 can be bent into the tubular shape at the second end 1134 to define the bolt engagement portion 430 and the bolt channel 1130.

In example aspects, the front stair engagement portion 435 can extend laterally from the bolt engagement portion 430 towards the first end 1132 of the front clamping bracket 130. The front stair engagement portion 435 can further extend substantially upward and forwards from the bolt engagement portion 430 towards the upper end 1136 and the front side 1140 of the front clamping bracket 130, relative to the orientation shown. Example aspects of the front stair engagement portion 435 can define a substantially planar sidewall 1150 extending substantially forward from bolt engagement portion 430 and configured to confront the first lateral side 344 of the staircase 310 (shown in FIG. 3). The sidewall 1150 can be bent relative to the bolt engagement portion 430, as shown. The front stair engagement portion 435 can further define a riser engagement wall 1160 extending from the sidewall 1150 towards the first end 1132 of the front clamping bracket 130. The riser engagement wall 1160 can be configured to confront the riser 322 of a corresponding stair 315. Specifically, a riser engagement surface 1260 (shown in FIG. 12) of the riser engagement wall 1160 can confront and abut the vertical riser surface 324 of the riser 322 (shown in FIG. 3). In example aspects, the riser engagement wall 1160 can be bent relative to the sidewall 1150 at about 90°.

The front stair engagement portion 435 can also define a tread engagement wall 1170 extending from the riser engagement wall 1160 generally towards the rear end of the front clamping bracket 130. The tread engagement wall 1170 can be configured to confront the tread 326 of the corresponding stair 315. Specifically, a tread engagement surface 1270 (shown in FIG. 12) of the tread engagement wall 1170 can confront and abut the horizontal tread surface 328 of the tread 326. In example aspects, the front clamping bracket 130 can be bent at an upper riser wall end 1162 of the riser engagement wall 1160 to define the tread engagement wall 1170, and the tread engagement wall 1170 can be oriented at about 90° (i.e., about perpendicular) relative to the riser engagement wall 1160. A bracket bend 1180 can be defined between the riser engagement wall 1160 and the tread engagement wall 1170, and the bracket bend 1180 can be configured to confront the upper front edge 320 of the corresponding stair 315 (shown in FIG. 3). In example aspects, a second retaining opening 1172 can be formed through the tread engagement wall 1170, as shown. Additionally, in some aspects, a riser opening 1164 can be defined through the riser engagement wall 1160, and a tread opening 1174 can be defined through the tread engagement wall 1170. As described above, in some aspects, the front clamping bracket 130 can be bolted to the staircase 310. For example, in some aspects, the staircase 310 can comprise concrete, and the front clamping bracket 130 can be bolted thereto with concrete anchor bolts. A concrete anchor bolt can extend through the riser opening 1164 to bolt the front clamping bracket 130 to the corresponding riser 322, and another concrete anchor bolt can extend through the tread opening 1174 to bolt the front clamping bracket 130 to the corresponding tread 326.

Figure 12:
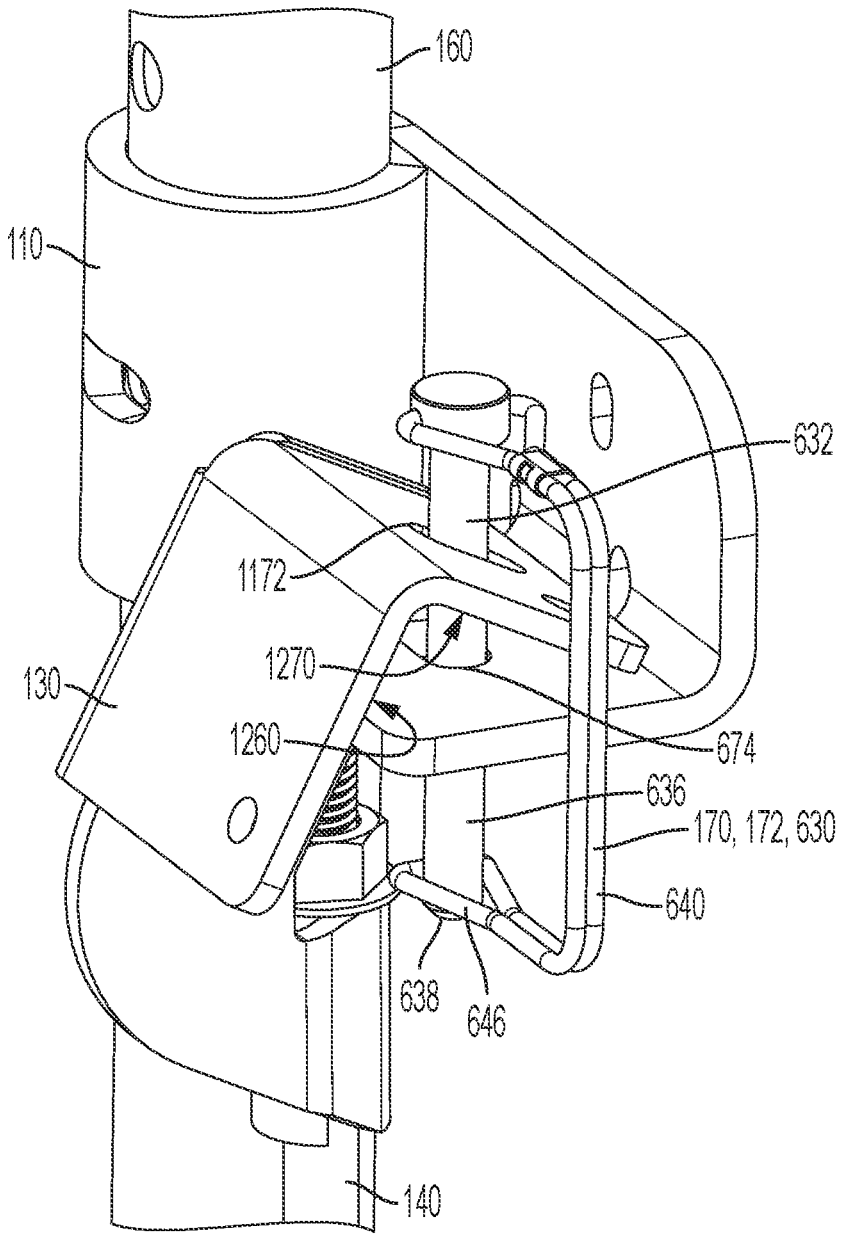
FIG. 12 is a perspective view of the front clamping bracket of FIG. 11 secured to the upper clamping bracket of FIG. 6A in the storage configuration.

FIG. 12 illustrates a detail view of the front clamping bracket 130 coupled to the upper clamping bracket 110 in the storage configuration. In the storage configuration, the storage lock pin 172 can secure the front clamping bracket 130 to the upper clamping bracket 110 to prohibit the front clamping bracket 130 from pivoting relative to the lower clamping bracket 120 (shown in FIG. 1) via the connector bolt 140. In the present aspect, the storage lock pin 172 can also be the positioning lock pin 630, and thus can define the pin rod 632 and the pin lock 640. As shown, the pin tail 636 of the pin rod 632 can extend through the second retaining opening 1172 of the front clamping bracket 130 and through the first retaining opening 674 of the upper clamping bracket 110, and the locking loop 646 can be hooked onto the distal tail end 638 of the pin tail 636 to prohibit the pin tail 636 from disengaging the first and second retaining openings 674,1172.

Figure 13A:
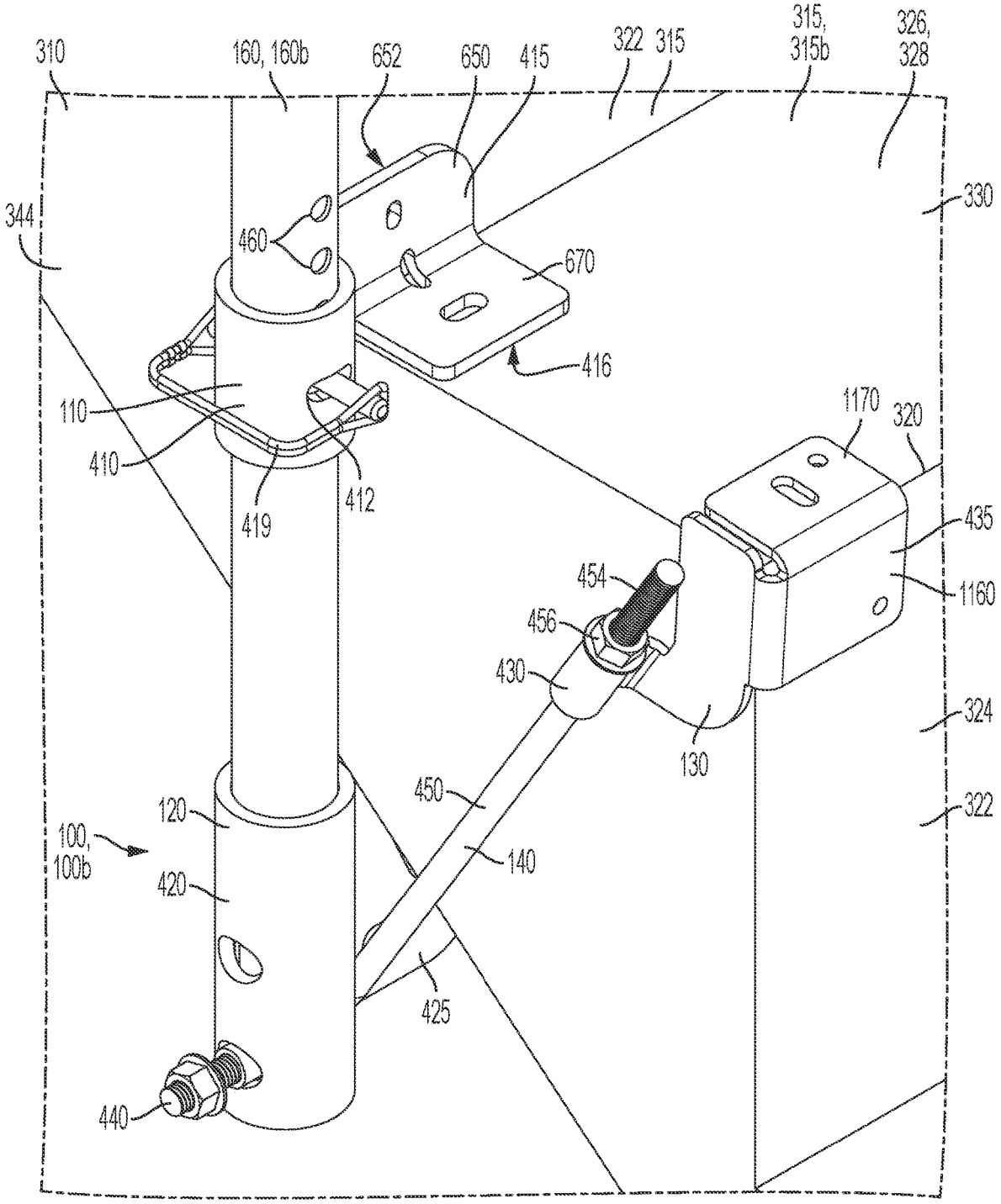
FIG. 13A is a detail top perspective view of the guardrail mounting bracket of FIG. 1 engaging the staircase of FIG. 3, taken from Detail 13A in FIG. 3.
Figure 13B:
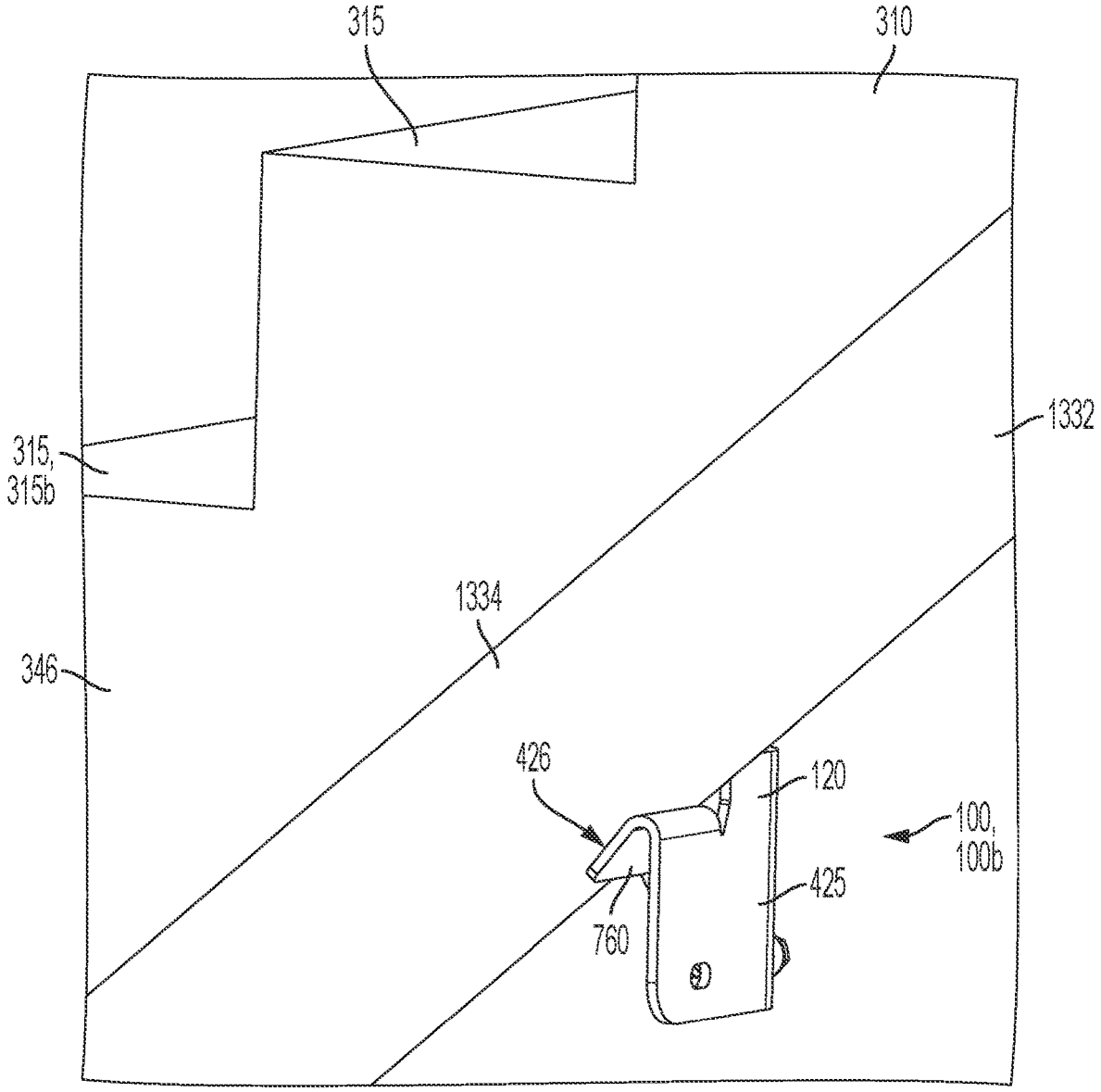
FIG. 13B is a bottom perspective view of the guardrail mounting bracket of FIG. 1 engaging the staircase of FIG. 3.

FIGS. 13A and 13B illustrate a top perspective view and a bottom perspective view, respectively, of the guardrail mounting bracket 100 mounting the guardrail post 160 to a corresponding stair 315 of the staircase 310. FIG. 13A is a detail view taken from Detail 13A in FIG. 3. Specifically, FIGS. 13A and 13B illustrate the lower guardrail mounting bracket 100*b* mounting the lower guardrail post 160*b* to the lower stair 315*b*. Referring to the upper clamping bracket 110, the guardrail post 160 can extend through the upper rail channel 610 (shown in FIG. 6) of the upper post engagement portion 410. The positioning pin 419 can engage the upper clamp opening 412 of the upper post engagement portion 410 and a desired one of the upper positioning openings 460 of the lower guardrail post 160*b* to couple the upper clamping bracket 110 to the lower guardrail post 160*b* at a desired position relative to lower clamping bracket 120. Furthermore, the upper stair engagement portion 415 can engage the upper staircase surface 330 of the staircase 310. Specifically, the upper stair engagement surface 416 of the horizontal upper engagement wall 670 can engage the horizontal tread surface 328 of the tread 326 of the lower stair 315*b*, distal to the upper front edge 320 of the lower stair 315*b*. The vertical wall surface 652 of the vertical upper extension wall 650 can confront, and in some instances can engage, the vertical riser surface 324 of an adjacent stair 315.

Referring to the lower clamping bracket 120, the guardrail post 160 can extend through the lower rail channel 720 (shown in FIG. 7) of the lower post engagement portion 420, and the lower arm 440 of the connector bolt 140 can slidably couple the lower clamping bracket 120 to the guardrail post 160. As shown in FIG. 13B, the lower clamping bracket 120 can be slid along the guardrail post 160 (shown in FIG. 13A) towards the staircase 310 to engage the lower stair engagement portion 425 with the lower staircase surface 1332. Specifically, the lower stair engagement surface 426 of the lower engagement wall 760 can engage the lower stair surface 1334 of the lower stair 315*b*. The lower stair 315*b* can thereby be positioned between the upper clamping bracket 110 and the lower clamping bracket 120.

The connector bolt 140 can further pivotably mount the front clamping bracket 130 to the lower clamping bracket 120. The upper arm 450 of the connector bolt 140 can extend through the bolt channel 1130 (shown in FIG. 11) of the bolt engagement portion 430, and the front clamping bracket 130 can slide along the upper arm 450. The front clamping bracket 130 can be slid along the upper arm 450 towards the upper front edge 320 of the lower stair 315*b* to engage the front stair engagement portion 435 with the lower stair 315*b* at the upper front edge 320 thereof. Specifically, the riser engagement surface 1260 (shown in FIG. 12) of the riser engagement wall 1160 can engage the vertical riser surface 324 of the riser 322, and the tread engagement surface 1270 (shown in FIG. 12) of the tread engagement wall 1170 can engage the horizontal tread surface 328 of the tread 326. The second threaded nut 456 can then be tightened on the second threaded portion 454 of the upper arm 450 of the connector bolt 140 to push the front clamping bracket 130 rearwards and downwards towards the lower clamping bracket 120 and against the upper front edge 320 of the lower stair 315*b*. As the second threaded nut 456 is further tightened on the upper arm 450 of the connector bolt 140, the engagement of the lower arm 440 with the lower clamping bracket 120 can draw the lower clamping bracket 120 upwards along the guardrail post 160 and can push the lower clamping bracket 120 against the lower stair surface 1334 (shown in FIG. 13B). The lower arm 440 of the connector bolt 140 can pivot relative to the lower clamping bracket 120 and can slide vertically within the guardrail post slot 565 (shown in FIG. 5A) of the guardrail post 160 as the lower clamping bracket 120 slides upward. The lower stair 315*b* can thereby be tightly clamped between the front clamping bracket 130 and the lower clamping bracket 120 and between the upper clamping bracket 110 and the lower clamping bracket 120.

Thus, according to example aspects, a method of mounting the staircase guardrail system 300 to a staircase 310 can comprise providing the staircase guardrail system 300 comprising the upper clamping bracket 110, the lower clamping bracket 120, the front clamping bracket 130, and the plurality of guardrails 150. Each of the upper clamping bracket 110 and the lower clamping bracket 120 can be mounted to one of the guardrail posts 160 of the plurality of guardrails 150. The front clamping bracket 130 can be coupled to the lower clamping bracket 120 by the connector (e.g., the connector bolt 140). The method can further comprise abutting the upper clamping bracket 110 against the upper staircase surface 330 of the staircase 310 and tightening the tightening fastener (e.g., the second threaded nut 456) on the connector. Tightening the tightening fastener on the connector can bias the front clamping bracket 130 against the upper front edge 320 of the corresponding stair 315 of the staircase 310 and can bias the lower clamping bracket 120 against the lower staircase surface 1332 of the staircase 310. In some aspects, the method can comprise bolting some or all of the upper clamping bracket 110, the lower clamping bracket 120, and the front clamping bracket 130 to the staircase 310. Furthermore, in some aspects, the method can comprise reconfiguring the guardrail mounting bracket 100 from the storage configuration to the use configuration. Reconfiguring the guardrail mounting bracket 100 from the storage configuration to the use configuration can comprise disengaging the storage fastener 170 from the guardrail mounting bracket 100. In some aspects, the storage fastener 170 can engage the front clamping bracket 130 and the upper clamping bracket 100 in the storage configuration to restrict movement of the connector bolt 140 and the front clamping bracket 130. In the use configuration, the front clamping bracket 130 can be permitted to pivot relative to the lower clamping bracket 120 via the connector bolt 140.

Figure 14A:
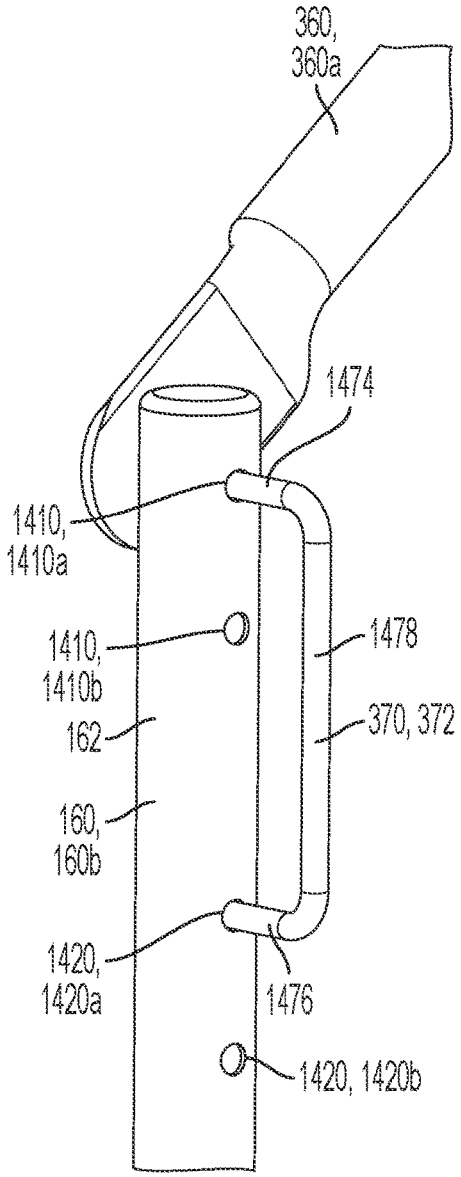
FIG. 14A is right side perspective view of guardrail connection.
Figure 14B:
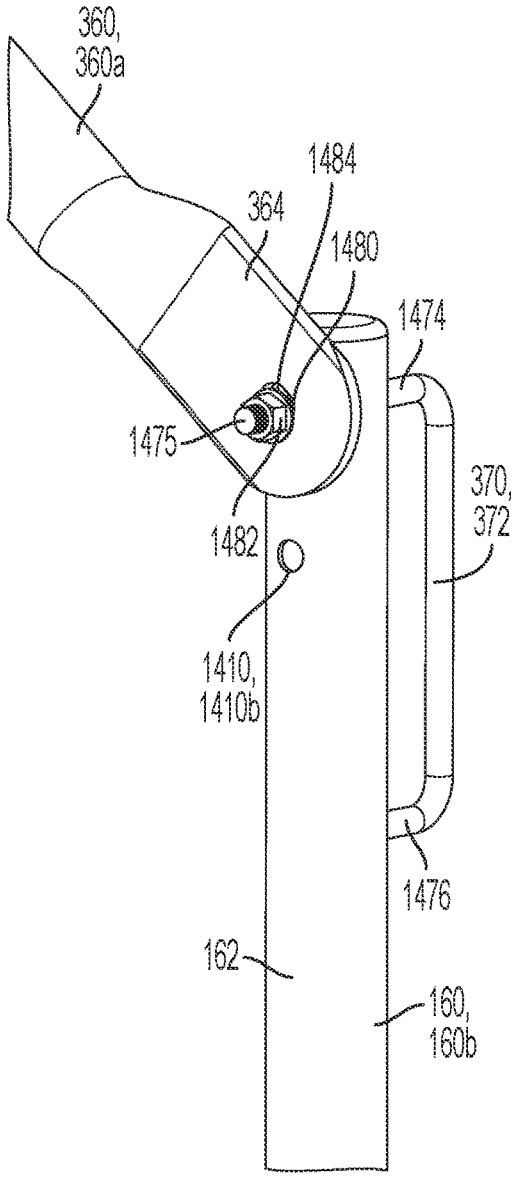
FIG. 14B is a left side perspective view of the guardrail connection of FIG. 14A.

FIGS. 14A and 14B illustrate right and left side perspective views of one the guardrail posts 160 coupled to one of the lateral guardrails 360. In some aspects, some or all of the lateral guardrails 360 can be directly or indirectly secured to the corresponding guardrail posts 160 with one of the securing fasteners 370, such as, for example, one of the securing pins 372. The present aspect illustrates the lower guardrail post 160*b* directly coupled to the top lateral guardrail 360*a*. When secured together, the guardrail posts 160 and lateral guardrails 360 can define the substantially upright boundary 380 along the first lateral side 344 of the staircase 310, as shown in FIG. 3.

The lower guardrail post 160*b* can define one or more upper mounting holes 1410 and one or more lower mounting holes 1420. In the present aspect, the lower guardrail post 160*b* can define first and second upper mounting holes 1410*a,b* and first and second lower mounting holes 1420*a,b* vertically spaced along the upper section 162 thereof. Example aspects of the securing pin 372 can be substantially U-shaped and can define an upper pin leg 1474, a lower pin leg 1476, and a cross-rod 1478 extending therebetween. The upper pin leg 1474 of the securing pin 372 can extend through one of the upper mounting holes 1410 and the lower pin leg 1476 of the securing pin 372 can extend through a corresponding one of the lower mounting holes 1420, depending upon the desired positioning of the lateral guardrail 360 relative to the guardrail post 160. For example, in the present aspect, the upper pin leg 1474 can extend through the first upper mounting hole 1410*a* and the lower pin leg 1476 can extend through the first lower mounting hole 1420*a*. In some aspects, the lower pin leg 1476 of securing pin 372 can be shorter than the upper pin leg 1474.

Additionally, in some aspects, the lower mounting holes 1420 can be blind holes, such that they do not extend fully through the guardrail post 160. Thus, in example aspects, the lower pin leg 1476 may not extend fully through the guardrail post 160, as shown in FIG. 14B. However, in other aspects, the lower mounting holes 1420 can be through-holes and the lower pin leg 1476 can extend fully through the guardrail post 160.

Referring to FIG. 14B, according to example aspects, the lower rail end 364 and the upper rail end 362 (shown in FIG. 3) of each of the lateral guardrails 360 can define an attachment opening 1480 therethrough. In the present aspect, the upper and lower rail ends 362,364 of the lateral guardrail 360 can be substantially flat, as shown. A distal leg end 1475 of the upper pin leg 1474 of the securing pin 372 can extend fully through the first upper mounting hole 1410*a* (shown in FIG. 14A), and can further extend through the attachment opening 1480 to mount the top lateral guardrail 360*a* to the lower guardrail post 160*b*. A threaded pin nut 1482 can be tightened on the upper pin leg 1474 to sandwich the lower rail end 364 of the top lateral guardrail 360*a* between the threaded pin nut 1482 and the lower guardrail post 160*b*. In some aspects, a pin washer 1484 can be mounted on the upper pin leg 1474 between the threaded pin nut 1482 and the top lateral guardrail 360*a*.

One should note that the different aspects disclosed herein can be combined such that the pipe fitting can include the features of more than one aspect. One should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

It should be emphasized that the above-described aspects are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described aspect(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A guardrail mounting bracket for a staircase, the guardrail mounting bracket comprising:

an upper clamping bracket comprising an upper post engagement portion and an upper stair engagement portion, the upper stair engagement portion defining an upper stair engagement surface;

a lower clamping bracket comprising a lower post engagement portion and a lower stair engagement portion, the lower stair engagement portion defining a lower stair engagement surface; and a front clamping bracket coupled to the lower clamping bracket and defining a front stair engagement portion;

wherein:

the upper post engagement portion defines an upper rail channel configured to receive a guardrail therethrough; and the lower post engagement portion defines a lower rail channel configured to receive the guardrail therethrough.

2. The guardrail mounting bracket of claim 1, wherein the front clamping bracket is pivotably coupled to the lower clamping bracket by a connector, the front clamping bracket comprising a connector engagement portion, the connector engaging the connector engagement portion.

3. The guardrail mounting bracket of claim 2, wherein the connector is a connector bolt defining an upper arm and a lower arm, the lower arm pivotably coupled to the lower clamping bracket, the upper arm extending through a bolt channel of the connector engagement portion.

4. The guardrail mounting bracket of claim 2, wherein the front clamping bracket is slidably adjustable along the connector towards and away from the lower clamping bracket.

5. The guardrail mounting bracket of claim 1, wherein:

the guardrail mounting bracket is configurable in a storage configuration and a use configuration;

the upper clamping bracket defines a first retaining opening therethrough and the front clamping bracket defines a second retaining opening therethrough; and a storage fastener extends through the first retaining opening and the second retaining opening to secure the guardrail mounting bracket in the storage configuration.

6. The guardrail mounting bracket of claim 1, wherein:

the upper stair engagement portion defines an upper extension wall extending laterally from the upper post engagement portion and an upper engagement wall extending from a lower wall end of the upper extension wall;

the lower stair engagement portion defines a lower extension wall extending laterally from the lower post engagement portion and a lower engagement wall extending from an upper wall end of the lower extension wall; and the upper engagement wall defines the upper stair engagement surface and the lower engagement wall defines the lower stair engagement surface.

7. The guardrail mounting bracket of claim 6, wherein:

each of the upper extension wall and the lower extension wall are oriented substantially vertically;

the upper engagement wall is oriented perpendicular to the upper extension wall; and the lower engagement wall is oriented at an acute angle relative to the lower extension wall.

8. The guardrail mounting bracket of claim 6, wherein:

the upper clamping bracket is monolithically formed and the upper engagement wall is bent relative to the upper extension wall; and the lower clamping bracket is monolithically formed and the lower engagement wall is bent relative to the lower extension wall.

9. The guardrail mounting bracket of claim 1, wherein:

the front stair engagement portion defines a riser engagement wall and a tread engagement wall extending from an upper riser wall end of the tread engagement wall;

the tread engagement wall is oriented perpendicular to the riser engagement wall; and the tread engagement wall defines a tread engagement surface and the riser engagement wall defines a riser engagement surface.

10. A guardrail mounting bracket for a staircase, the guardrail mounting bracket comprising:

an upper clamping bracket comprising an upper post engagement portion and an upper stair engagement portion, the upper stair engagement portion defining an upper stair engagement surface;

a lower clamping bracket comprising a lower post engagement portion and a lower stair engagement portion, the lower stair engagement portion defining a lower stair engagement surface; and a front clamping bracket coupled to the lower clamping bracket and defining a front stair engagement portion;

wherein the front clamping bracket is pivotably coupled to the lower clamping bracket by a connector, the front clamping bracket comprising a connector engagement portion, the connector engaging the connector engagement portion; and wherein the connector is a connector bolt defining an upper arm and a lower arm, the lower arm pivotably coupled to the lower clamping bracket, the upper arm extending through a bolt channel of the connector engagement portion.

11. The guardrail mounting bracket of claim 10, wherein the front clamping bracket is slidably adjustable along the connector towards and away from the lower clamping bracket.

12. The guardrail mounting bracket of claim 10, wherein:

the guardrail mounting bracket is configurable in a storage configuration and a use configuration;

the upper clamping bracket defines a first retaining opening therethrough and the front clamping bracket defines a second retaining opening therethrough; and a storage fastener extends through the first retaining opening and the second retaining opening to secure the guardrail mounting bracket in the storage configuration.

13. The guardrail mounting bracket of claim 10, wherein:

the front stair engagement portion defines a riser engagement wall and a tread engagement wall extending from an upper riser wall end of the tread engagement wall;

the tread engagement wall is oriented perpendicular to the riser engagement wall; and the tread engagement wall defines a tread engagement surface and the riser engagement wall defines a riser engagement surface.

14. A guardrail mounting bracket for a staircase, the guardrail mounting bracket comprising:

an upper clamping bracket comprising an upper post engagement portion and an upper stair engagement portion, the upper stair engagement portion defining an upper stair engagement surface;

a lower clamping bracket comprising a lower post engagement portion and a lower stair engagement portion, the lower stair engagement portion defining a lower stair engagement surface; and a front clamping bracket coupled to the lower clamping bracket and defining a front stair engagement portion;

wherein:

the guardrail mounting bracket is configurable in a storage configuration and a use configuration;

the upper clamping bracket defines a first retaining opening therethrough and the front clamping bracket defines a second retaining opening therethrough; and a storage fastener extends through the first retaining opening and the second retaining opening to secure the guardrail mounting bracket in the storage configuration.

15. The guardrail mounting bracket of claim 14, wherein the front clamping bracket is pivotably coupled to the lower clamping bracket by a connector, the front clamping bracket comprising a connector engagement portion, the connector engaging the connector engagement portion.

16. The guardrail mounting bracket of claim 15, wherein the connector is a connector bolt defining an upper arm and a lower arm, the lower arm pivotably coupled to the lower clamping bracket, the upper arm extending through a bolt channel of the connector engagement portion.

17. The guardrail mounting bracket of claim 15, wherein the front clamping bracket is slidably adjustable along the connector towards and away from the lower clamping bracket.

18. The guardrail mounting bracket of claim 14, wherein:

the front stair engagement portion defines a riser engagement wall and a tread engagement wall extending from an upper riser wall end of the tread engagement wall;

the tread engagement wall is oriented perpendicular to the riser engagement wall; and the tread engagement wall defines a tread engagement surface and the riser engagement wall defines a riser engagement surface.

* * * * *